US005104774A

United States Patent [19]

Ohki et al.

[11] Patent Number: 5,104,774

[45] Date of Patent: Apr. 14, 1992

[54] IMAGE FORMING METHOD

[75] Inventors: Nobutaka Ohki; Hiroyuki Yoneyama, both of Kanagawa, Japan

[73] Assignee: Fuji Photo Film Co., Ltd., Kanagawa, Japan

[21] Appl. No.: 506,253

[22] Filed: Apr. 9, 1990

[30] Foreign Application Priority Data

Apr. 10, 1989 [JP] Japan ..... 1-90088

[51] Int. Cl.[5] ..... G03C 7/28; G03C 7/34

[52] U.S. Cl. ..... 430/372; 430/384; 430/385; 430/393; 430/551; 430/552; 430/553

[58] Field of Search ..... 430/551, 572, 384, 552, 430/553, 393, 385, 372

[56] References Cited

U.S. PATENT DOCUMENTS

| | | | |
|---|---|---|---|
| 2,735,765 | 2/1956 | Loria et al. | 95/6 |
| 4,178,184 | 12/1979 | Taguchi et al. | 430/503 |
| 4,277,558 | 7/1981 | Kikuchi et al. | 430/542 |
| 4,904,575 | 2/1990 | Ono et al. | 430/385 |
| 4,923,783 | 5/1990 | Kobayashi et al. | 430/377 |
| 4,945,031 | 7/1990 | Sakai et al. | 430/393 |
| 4,983,506 | 1/1991 | Ono et al. | 430/531 |
| 4,988,613 | 1/1991 | Ohki et al. | 430/547 |

FOREIGN PATENT DOCUMENTS 2071348 9/1981 United Kingdom .

*Primary Examiner*—Marion E. McCamish
*Assistant Examiner*—Janis L. Dote
*Attorney, Agent, or Firm*—Burns, Doane, Swecker & Mathis

[57] ABSTRACT

An image forming method comprising imagewise exposure and color development of a multilayer silver halide color photographic material comprising a support having thereon at least one silver halide light-sensitive emulsion layer containing at least one oil-soluble coupler which is capable of forming a substantially non-diffusible cyan dye upon coupling with an oxidation product of an aromatic primary amine developing agent and which is represented by formula (I), and at least one compound selected from the group consisting of compounds represented by formula (II) or (III) followed by the processing of the multilayer silver halide color photographic material with at least one of a bleaching solution and bleach-fixing solution each having a pH of not higher than 6.3, wherein formula (I), (II) and (III) comprise (I)

(II)

(III)

wherein Y represents —NHCO— or —CONH—; $R_1$ represents an alkyl group, an aryl group, a heterocyclic group or an amino group; X represents a hydrogen atom, a halogen atom, an alkoxy group or an acylamino group; $R_2$ represents an alkyl group or an acylamino group, or X and $R_2$ together represent a non-metallic atomic group necessary for forming a 5-membered, 6-membered or 7-membered ring; Z represents a hydrogen atom or a group capable of being released at the time of coupling with the oxidation product of the developing agent; $R_3$ and $R_5$ each represents a halogen atom, an acyl group, an alkyl- or arylsulfonyl group or a carbamoyl group, $R_4$ and $R_6$ each represents a hydrogen atom, an alkyl gorup, an aryl group, an alkoxy group, an aryloxy group, an alkylthio group, an arylthio group or an amido group; and the total number of carbon atoms included in the groups represented by $R_3$ and $R_4$ or the groups represented by $R_5$ and $R_6$ is not less than 8.

22 Claims, No Drawings

IMAGE FORMING METHOD

FIELD OF THE INVENTION

The present invention relates to an image forming method for silver halide color photographic materials, and more particularly, to an image forming method which prevents the degradation of the image which occurs during the preservation of the print after the color development processing steps due to changes in the cyan dye density.

BACKGROUND OF THE INVENTION

In order to form color photographic images, a photographic material having three kinds of photographic color couplers, i.e., yellow, magenta and cyan couplers incorporated in light-sensitive layers thereof is imagewise exposed and then processed with a color developing solution containing a color developing agent. In this process, the couplers react with the oxidation products of aromatic primary amine developing agents to yield colored dyes.

In general, the standard steps for processing silver halide color photographic materials are composed of a color development step for forming color images, a desilvering step for removing developed silver and undeveloped silver, and a water washing step and/or an image stabilizing step.

The art has sought a reduction in processing time for the photographic materials. Recently, however, the necessity for shortening this processing time has become more important because of requirements relating to a reduction in the period to finish, a simplification of the laboratory work, and the miniaturization and simple operations associated with the processing systems for small scale laboratories, i.e., "mini-labs".

A reduction in the processing time for the color development step can be achieved by using a coupler having as high a coupling speed as possible, using a silver halide emulsion having a high developing speed, using a color developing solution having a high developing speed, using a color developing solution of high temperature or any appropriate combination thereof.

On the other hand, the reduction of processing time for the desilvering step can be obtained by decreasing the pH of the bleaching solution or bleach-fixing solution. For example, *The Theory of the Photographic Process,* Chapter 15E, Bleach-Fix System discloses that the bleach-fixing speed increases upon lowering of the pH of the bleach-fixing solution.

However, although a reduction in the pH of the bleach-fixing solution is effective in increasing the bleaching speed, it also causes leuco-body formation of the cyan dye formed from cyan coupler and results in decrease in density because the leuco-body does not turn into the colored form at the completion of the processing. This phenomenon is hereafter referred to as "inferior recoloring". Due to gradual recoloring of cyan dye after the processing, the color balance is lost thereby deteriorating the image quality.

In order to solve this problem, there is a method wherein after color development, the photographic material is washed with water to remove the developing agent before the bleach-fixing step is conducted. However, this method is disadvantageous because of the increase in the number of processing steps employed as well as the total processing time.

Another method wherein a water-soluble ionic compound containing a polyvalent element is added to the bleach-fixing bath is proposed, for example, in U.S. Pat. No. 3,773,510. This method, however, introduces problems associated with environmental pollution. Further, the desired object is not fully achieved.

On the other hand, it is also known to employ hydroquinones or quinones for the purpose of control of gradation, prevention of fog, and prevention of color fading of magenta dye. See, for example, JP-A-55-161238 (the term "JP-A" as used herein means an "unexamined published Japanese patent application"), JP-A-60 60647, JP-A-53-32034 (corresponding to German Patent Application (OLS) No. 2639930), OLS Nos. 2,149,789 and 3,320,483Al, JP-A-58-24141, JP-A-46-2128 (corresponding to U.S. Pat. No. 3,700,453), JP-B-43-4934 (the term "JP B" as used herein means an "examined Japanese patent publication"), JP-B-50-21249, JP-B-60-3I71, JP-A-49-106329, JP-A-49-129535, British Patent 1,465,081, JP-A-49-129536, JP-A-49-134327, JP-A-50-110337, JP-A-50-156438, JP-A-51-6024, JP-A-51-9828, JP-A-51-14023, JP-A-52-65432, JP-A-52-128130, JP-A-52-146234, JP-A-52-146235, JP-A-53-9528, JP-A-53-55121, JP-A-53-139533, JP-A-54-24019, JP-A-54-25823, JP-A-54-29637, JP-A-54-70036, JP-A-54-97021 (corresponding to OLS No. 2901520), JP-A54-133181, JP-A-55-95948, JP-A-56-5543, JP-A-56-83742, JP-A-56-85748, JP-A-56-87040, JP-A-56-153342, JP-A-57-112749, JP-A-57-176038, JP-A-58-136030, JP-A-59-72443, JP-A-59-75249, JP-A-59-83162, JP-A-59-101650, JP-A-59-180557, JP-A-60-60647, JP-A-59-189342, JP-A-59-191031, JP-A-60-55339, JP-A-60-263149, *Research Disclosure,* No. 228-7 (1983), U.S. Pat. Nos. 2,384,658, 2,403,721, 2,728,659, 2,735,765, 3,700,453, 2,675,314, 2,732,300 and 2,360,290. In particular, fog prevention by incorporating hydroquinones substituted with an electron withdrawing group into an intermediate layer is described in JP-B-59-35012, JP-A-56-109344 and JP-A-57-2237. However, these documents do not discuss the problems associated with inferior recoloring.

It is known that the addition of such hydroquinones tends to cause the inferior recoloring when a bleach-fixing solution of relatively high pH and which is contaminated with a color developing solution is employed. Therefore, it has been proposed to reduce the amount of hydroquinones employed. See, for example, JP-A-60-60647.

In JP-A-63-316857, alkyl-substituted hydroquinone or quinones are employed to prevent the inferior recoloring which occurs upon processing with a bleachfixing solution having a low pH (not higher than 6.3). Although the desired effect is obtained to some extent, further improvement is nonetheless desired. Moreover, another problem has recently been encountered in that the cyan color image is degraded when the processed photographic material is exposed during storage to irradiation of very high illuminance.

SUMMARY OF THE INVENTION

Therefore, an object of the present invention is to provide an image forming method for silver halide color photographic material which has excellent rapid processing properties, i.e., color development processing especially desilvering processing may be conducted in a short period of time.

Another object of the present invention is to provide an image forming method for silver halide color photographic materials which prevents the inferior recoloring of cyan dye image due to the low pH (not higher than 6.3) at the desilvering process. Moreover, the image quality is improved because the deterioration of the color balance of the image after processing does not occur.

A further object of the present invention is to provide an image forming method for silver halide color photographic materials which provides for the production of cyan color images which have good preservability.

Other objects of the present invention will become apparent from the following description and examples.

As a result of intensive-investigations, it has been found that the above described objects of the present invention can be accomplished with an image forming method which comprises the imagewise exposure and color development processing of a multilayer silver halide color photographic material. This material comprises a support having thereon at least one silver halide light-sensitive emulsion layer containing at least one oil-soluble coupler which is capable of forming a substantially non-diffusible cyan dye upon coupling with an oxidation product of an aromatic primary amine developing agent and which is represented by formula (I) described below and at least one compound represented by the formula (II) or (III) below. After development, the multilayer silver halide color photographic material is processed with at least one of a bleaching solution and bleach-fixing solution each having a pH of not higher than 6.3.

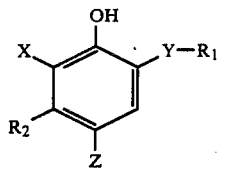

(I)

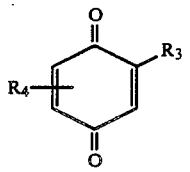

(II)

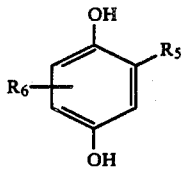

(III)

wherein Y represents —NHCO— or —CONH—; $R_1$ represents an alkyl group, an aryl group, a heterocyclic group or an amino group; X represents a hydrogen atom, a halogen atom, an alkoxy group or an acylamino group (in the present invention, an acyl group or moiety includes an aliphatic and aromatic acyl group or moiety); $R_2$ represents an alkyl group or an acylamino group, or X and $R_2$ together represent a non-metallic atomic group necessary for forming a 5-membered, 6-membered or 7-membered ring; Z represents a hydrogen atom or a group capable of being released at the time of coupling with the oxidation product of the developing agent; $R_3$ and $R_5$ each represents a halogen atom, an acyl group, an alkylor arylsulfonyl group, an alkoxycarbonyl group, an aryloxycarbonyl group, a carbamoyl group, a sulfamoyl group, an alkyl- or arylsulfinyl group, a cyano group, a nitro group or an alkyl group having at least one halogen atom at the α-position; $R_4$ and $R_6$ each represents a hydrogen atom, an alkyl group, an aryl group, an alkoxy group, an aryloxy group, an alkylthio group, an arylthio group or an amido group; wherein the total number of carbon atoms included in the groups represented by $R_3$ and $R_4$ or the groups represented by $R_5$ and $R_6$ is not less than 8.

DETAILED DESCRIPTION OF THE PREFERRED EMBODIMENTS OF THE INVENTION

In the coupler of formula (I), $R_1$ represents a group preferably having from 1 to 32 carbon atoms (including carbon atoms of substituent(s): the same hereinafter). $R_1$ represents an alkyl group preferably a straight chain, branched chain or cyclic alkyl group (for example, methyl, butyl, pentadecyl, or cyclohexyl), an aryl group (for example, phenyl, or naphthyl), a heterocyclic group, preferably 5- to 7-membered group having at least one of N, O and S atoms as hetero atom (the same hereinafter) (for example, 2-pyridyl, 3-pyridyl, 2-furyl, or 2-oxazolyl), or an amino group. The groups may be preferably substituted with one or more substituents selected from an alkyl group, an aryl group, an alkyl- or aryloxy group (for example, methoxy, dodecyloxy, methoxyethoxy, phenyloxy, 2,4-di-tert-amylphenyloxy, 3-tert-butyl-4-hydroxyphenyloxy, or naphthyloxy), a carboxy group, an alkyl- or arylcarbonyl group (for example, acetyl, tetradecanoyl, or benzoyl), an alkyl- or aryloxycarbonyl group (for example, methoxycarbonyl, benzyloxycarbonyl, or phenoxycarbonyl), an acyloxy group (for example, acetoxy, benzoyloxy, or benzylcarbonyloxy), a sulfamoyl group (for example, N-ethylsulfamoyl, or N-octadecylsulfamoyl), a carbamoyl group (for example, N-methylcarbamoyl, or N-methyl-N-dodecylcarbamoyl), an alkyl- or arylsulfonamido group (for example, methanesulfonamido, or benzenesulfonamido), an acylamino group (for example, acetylamino, benzamido, ethoxycarbonylamino, or phenylaminocarbonylamino), an imido group (for example, succinimido, or hydantoinyl), an alkyl- or arylsulfonyl group (for example, methanesulfonyl), a hydroxy group, a cyano group, a nitro group and a halogen atom. These substituents may be further substituted with one or more of these substituents as disclosed in parenthesis above as examples.

In formula (I), $R_2$ represents an alkyl group, preferably an alkyl group having from 1 to 20 carbon atoms (for example, methyl, ethyl, butyl, or pentadecyl) or an acylamino group preferably having from 2 to 30 carbon atoms (for example, tetradecanoylamino, benzoylamino, or 2-(2,4-di-tert-amylphenoxy)butanamido). The alkyl group represented by $R_2$ may be substituted with one or more substituents such as those described for $R_1$, and these substituents may be further substituted with one or more of such substituents.

In formula (I), X represents a hydrogen atom, a halogen atom, an alkoxy group preferably having from 1 to 20 carbon atoms (for example, methoxy, butoxy) or an acylamino group preferably having from 2 to 10 carbon atoms (for example, acetamido).

The compounds represented by the formula (I) preferably include condensed ring type cyan couplers in which $R_2$ and X are combined with each other to form a 5-membered, 6-membered or 7-membered ring (for example, a hydrocarbon ring or a heterocyclic ring), in addition to the above described phenol type cyan couplers. Among such condensed ring type cyan couplers, oxyindole type and imidazol-2-one type cyan couplers are particularly preferred.

In the formula (I), Z represents a hydrogen atom or a group capable of being released upon coupling. Examples of the groups capable of being releasing upon coupling include a halogen atom (for example, fluorine, chlorine, or bromine), an alkoxy group (for example, ethoxy, dodecyloxy, methoxycarbamoylmethoxy, carboxypropyloxy, or methylsulfonylethoxy), an aryloxy group (for example, 4-chlorophenoxy, 4-methoxyphenoxy, or 4-carboxyphenoxy), an acyloxy group (for example, acetoxy, tetradecanoyloxy, or benzoyloxy), an alkyl- or arylsulfonyloxy group (for example, methanesulfonyloxy, or toluenesulfonyloxy), an amido group (for example, dichloroacetylamino, heptafluorobutyrylamino, methanesulfonylamino, or toluenesulfonylamino), an alkoxycarbonyloxy group (for example, ethoxycarbonyloxy, or benzylcarbonyloxy), an aryloxycarbonyloxy group (for example, phenoxycarbonyloxy), an aliphatic or aromatic thio group (for example, ethylthio, phenylthio, or tetrazolylthio), an imido group (for example, a succinimido, or hydantoinyl), a N-heterocyclic group (a heterocyclic group substituted to the benzene ring at the N atom: for example, 1-pyrazolyl, or 1-benzotriazolyl), and an aromatic azo group (for example, phenylazo). These groups may also contain a photographically useful group.

In formulae (II) and (III), $R_3$ and $R_5$ each represents a halogen atom (for example, fluorine, chlorine, bromine, or iodine), an acyl group (preferably an acyl group having from 2 to 40 carbon atom, for example, acetyl, benzoyl, or hexadecanoyl), a sulfonyl group (preferably an aliphatic or aromatic sulfonyl group having from 1 to 40 carbon atoms, for example, methanesulfonyl, benzenesulfonyl, or 4-dodecyloxybenzenesulfonyl), an alkoxycarbonyl group (preferably an alkoxycarbonyl group having from 2 to 40 carbon atoms, for example, methoxycarbonyl, or hexyloxycarbonyl), an aryloxycarbonyl group (preferably an aryloxycarbonyl group having from 7 to 40 carbon atoms, for example, phenoxycarbonyl), a carbamoyl group (preferably a carbamoyl group having from 1 to 40 carbon atoms, for example, N-dodecylcarbamoyl, or N,N-diphenylcarbamoyl), a sulfamoyl group (preferably a sulfamoyl group having from 0 to 40 carbon atoms, for example, N,N-dipropylsulfamoyl, or N-phenylsulfamoyl), a sulfinyl group (preferably a sulfoxido group having from 1 to 40 carbon atoms, for example, methylsulfinyl, or octylsulfinyl), a cyano group, a nitro group or an alkyl group having at least one halogen atom at the $\alpha$-position (preferably an alkyl group having from 1 to 40 carbon atoms, for example, trifluoromethyl, or 1,1-dichloroethyl), and $R_4$ R4 and $R_6$ each represent a hydrogen atom, an alkyl group (preferably a straight chain or branched chain alkyl group having from 1 to 40 carbon atoms, for example, methyl, tert-butyl, hexyl, tert-octyl, sec-dodecyl, or sec-eicosyl), an aryl group (preferably an aryl group having from 6 to 40 carbon atoms, for example, phenyl, or tolyl), an alkoxy group (preferably an alkoxy group having from 1 to 40 carbon atoms, for example, methoxy, hexyloxy, or tetradecyloxy), an aryloxy group (preferably an aryloxy group having from 6 to 40 carbon atoms, for example, phenoxy, or p-acetamidophenoxy), an alkylthio group (preferably an alkylthio group having from 1 to 40 carbon atoms, for example, butylthio, dodecylthio, or octadecylthio), an arylthio group (preferably an arylthio group having from 6 to 40 carbon atoms, for example, phenylthio) or an amido group (preferably an amido group having from 2 to 40 carbon atoms, for example, acetamido, benzoylamino, or hexadecanamido). These groups may be further substituted as described for $R_1$. The total number of carbon atoms included in the groups represented by $R_3$ and $R_4$ or the groups represented by $R_5$ and $R_6$ is not less than 8, and it is preferably not more than 60.

The compound represented by the formula (II) or (III) may form a bis compound, a tris compound, an oligomer or a polymer.

In the formula (I), Y is preferably —NHCO—, and $R_1$ is preferably an alkyl group or an aryl group, more preferably an alkyl group.

$R_2$ in the formula (I) is preferably an alkyl group having from 1 to 15 carbon atoms, more preferably an alkyl group having from 1 to 4 carbon atoms.

Z in formula (I) is preferably a hydrogen atom or a halogen atom, more preferably a halogen atom.

X in formula (I) is preferably a halogen atom, and the case where X and $R_2$ are connected with each other to form a heterocyclic ring is also preferred.

In formulae (II) and (III), each of $R_3$ and $R_5$ is preferably a halogen atom, an acyl group, an alkyl- or arylsulfonyl group or a carbamoyl group, more preferably a halogen atom or a sulfonyl group, and still more preferably a halogen atom.

$R_4$ and $R_6$ in formulae (II) and (III) are preferably a hydrogen atom, an alkyl group, an alkylthio group or an amido group, more preferably an alkyl group.

$R_3$ and $R_4$ in formula (II) or $R_5$ and $R_6$ in formula (III) are preferably present at the 2- and 5-position. At least one of $R_3$ and $R_4$ or at least one of $R_5$ and $R_6$ is preferably an oleophilic (hydrophobic) group.

Although the following compounds are specific examples of the compounds represented by formula (I), (II) or (III), the present invention should not be construed as being limited to these compounds.

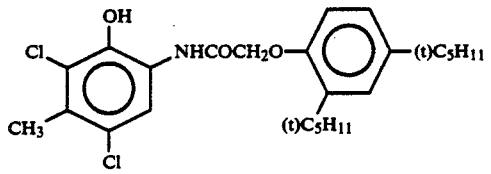

(C-1)

-continued
(C-2)
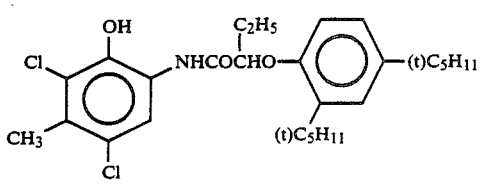
(C-3)
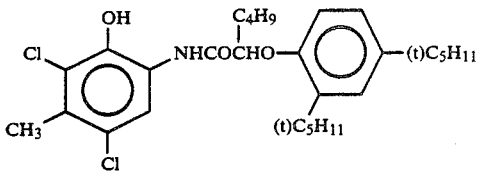
(C-4)
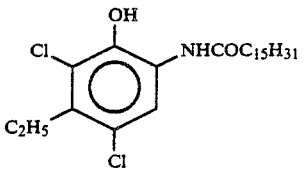
(C-5)
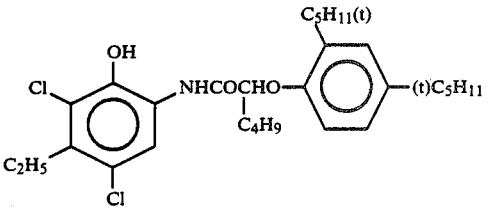
(C-6)
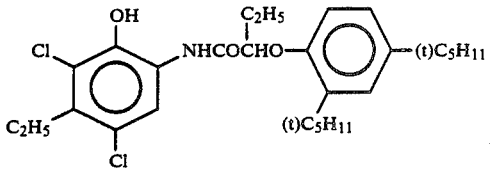
(C-7)
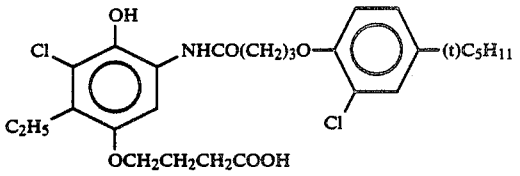
(C-8)
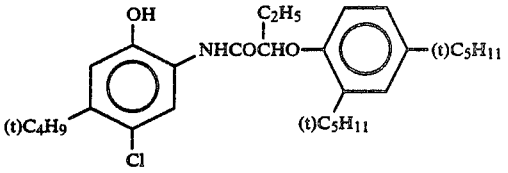
(C-9)
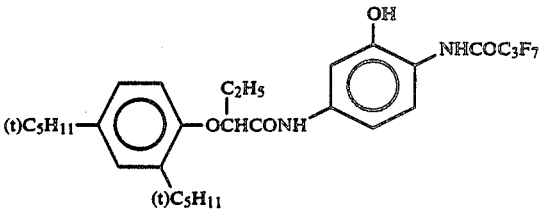

-continued
(C-10)
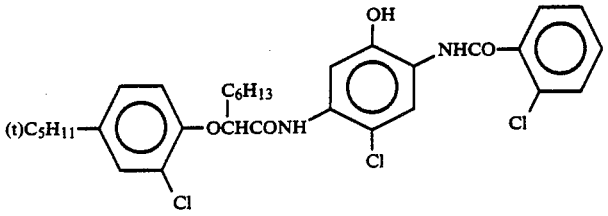
(C-11)
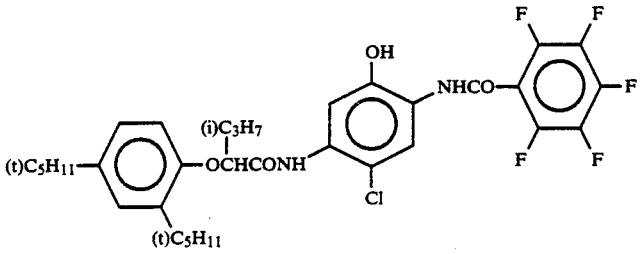
(C-12)
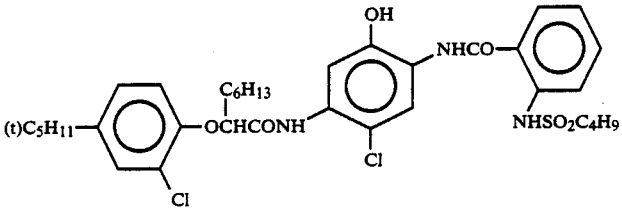
(C-13)
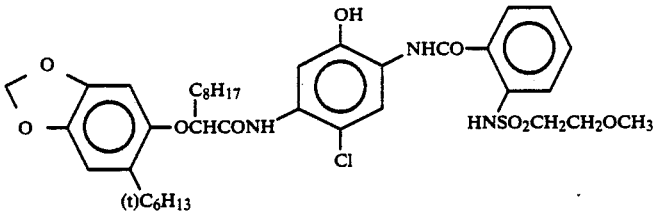
(C-14)
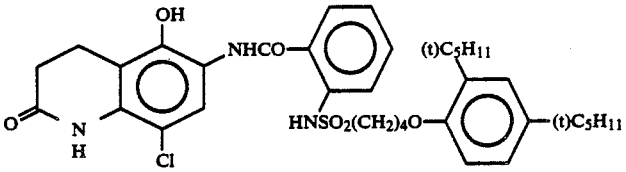
(C-15)
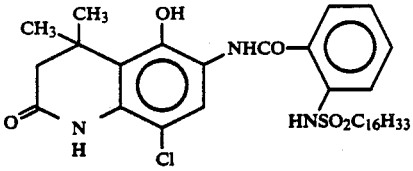
(C-16)
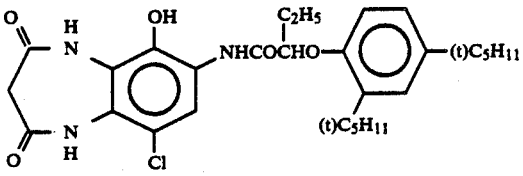

-continued
(C-17)
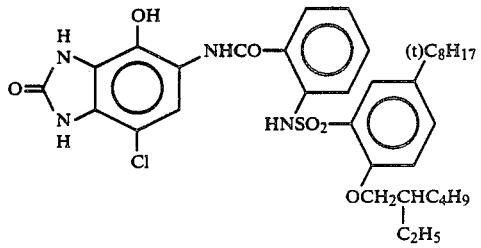
(C-18)
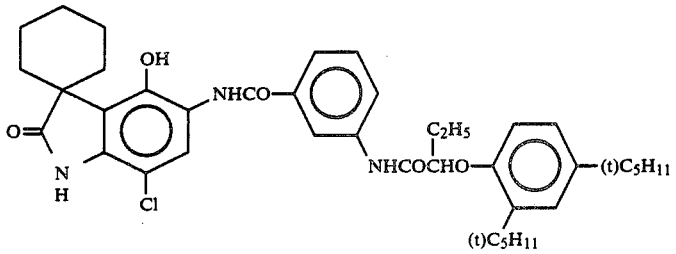
(C-19)
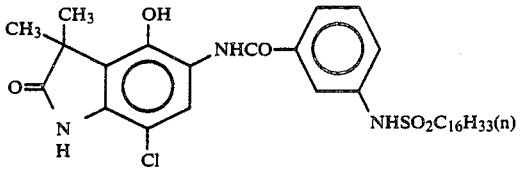
(C-20)
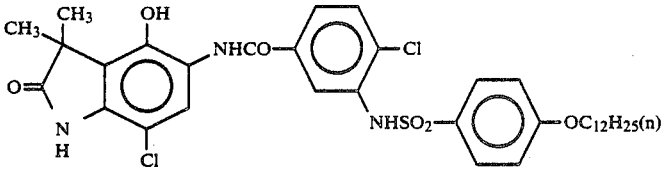
(C-21)
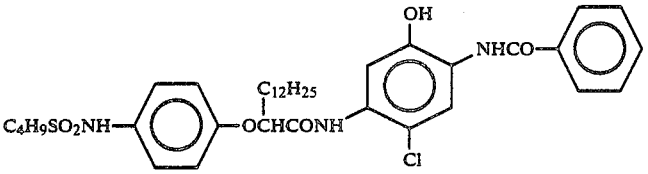
(C-22)
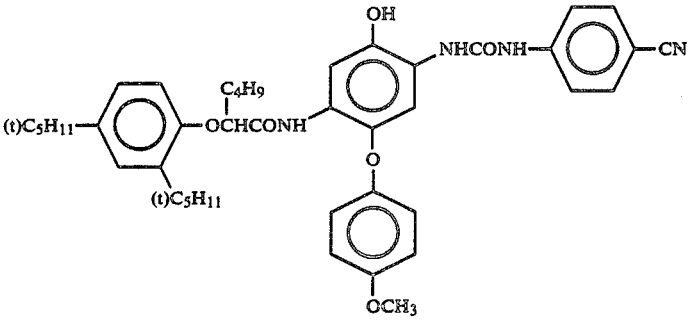
(C-23)
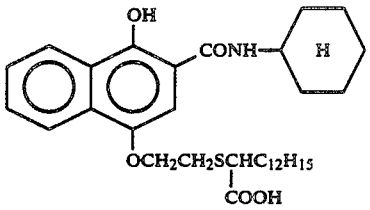

-continued
(C-24)
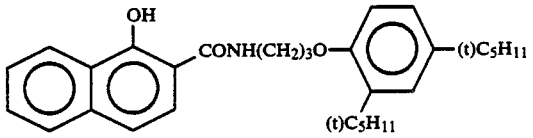
(C-25)
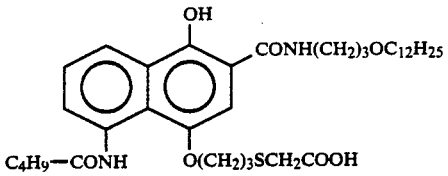
(C-26)
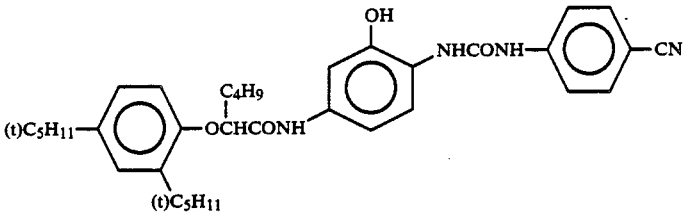
(II-1)
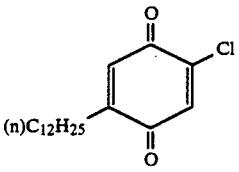
(II-2)
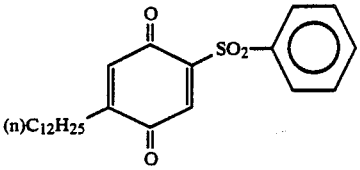
(II-3)
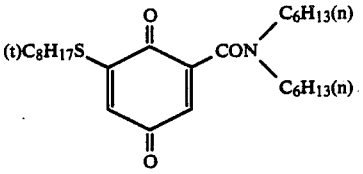
(II-4)
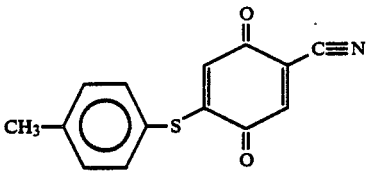
(II-5)
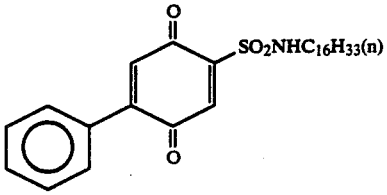

-continued
(II-6)
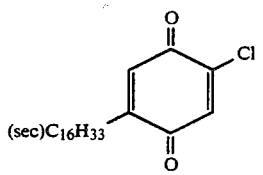
(II-7)
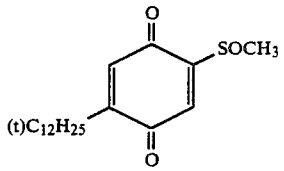
(II-8)
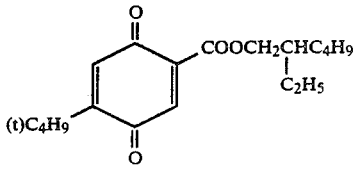
(II-9)
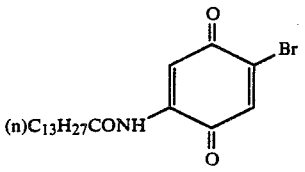
(II-10)
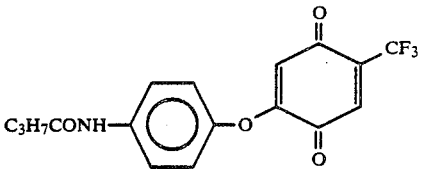
(II-11)
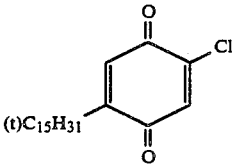
(II-12)
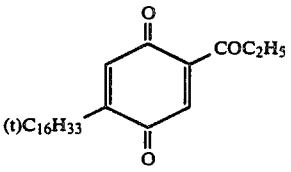
(II-13)
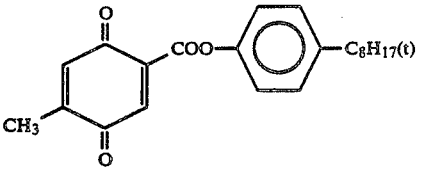
(II-14)
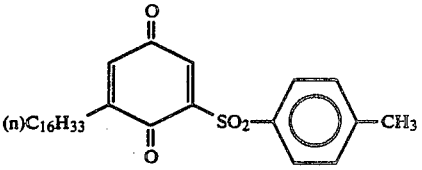

-continued
(II-15)
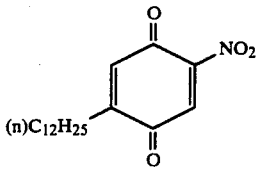
(III-1)
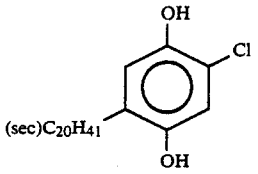
(III-2)
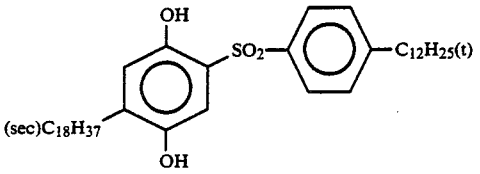
(III-3)
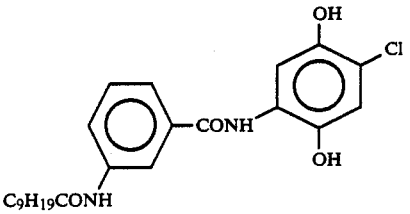
(III-4)
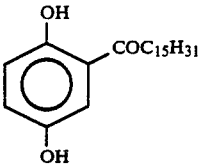
(III-5)
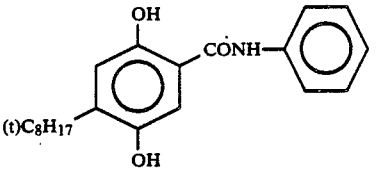
(III-6)
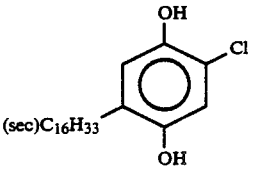
(III-7)
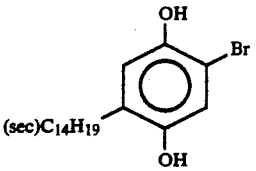
(III-8)
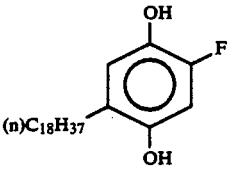

-continued
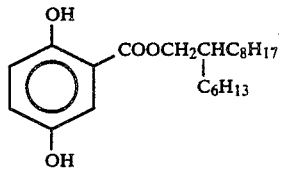
(III-9)
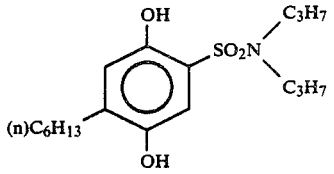
(III-10)
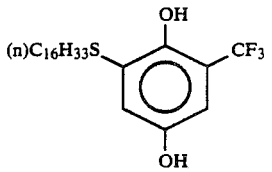
(III-11)
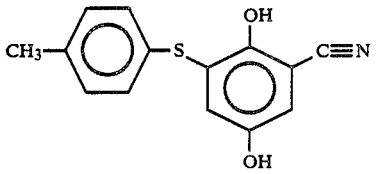
(III-12)
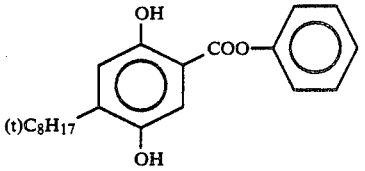
(III-13)
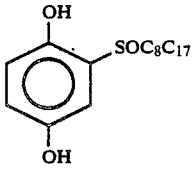
(III-14)
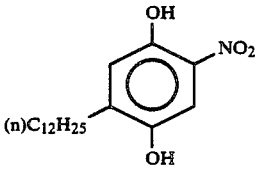
(III-15)
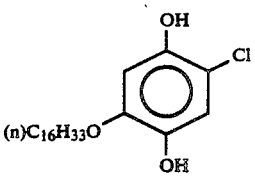
(III-16)
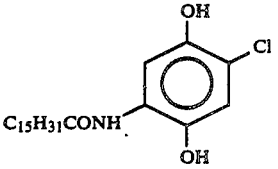
(III-17)

-continued

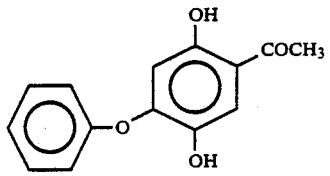

(III-18)

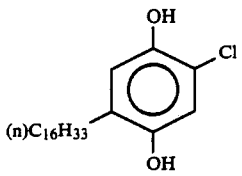

(III-19)

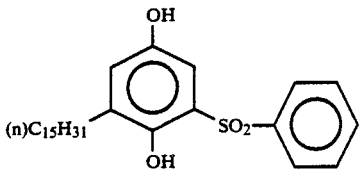

(III-20)

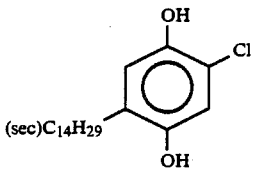

(III-21)

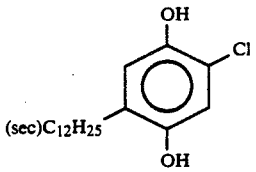

(III-22)

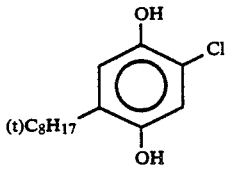

(III-23)

Cyan couplers represented by formula (I) are disclosed in, for example, JP-A-63-316857.

The compounds represented by the formula (II) or (III) can be synthesized according to methods known in the art. For example, those methods described in JP-A-56-109344 and JP-A-57-22237. In addition, they can be synthesized in accordance with the following synthesis examples.

SYNTHESIS EXAMPLE 1

Synthesis of Compound (III-6)

33.5 g (0.1 mole) of 2-sec-hexadecylhydroquinone was dissolved in 300 ml of methylene chloride, the solution was stirred at room temperature and 8.1 ml (0.1 mole) of sulfuryl chloride was added dropwise thereto over a period of 30 minutes. After stirring for 6 hours at room temperature, the mixture was allowed to stand over night, and then extracted with ethyl acetate. The extract was washed three times with a 5% aqueous solution of sodium chloride, dried with magnesium sulfate and concentrated. The residue was purified by column chromatography (where the solvent was chloroform) to obtain 27 g of the desired compound, i.e., 2-chloro-5-sec-hexadecylhydroquinone as a light brown oily product. The structure of the compound was confirmed by NMR and mass spectrum.

Elemental Analysis:

Calculated for $C_{22}H_{37}ClO_2$: C;71.61, H:10.11,

Found: C:71.38, H:10.35.

SYNTHESIS EXAMPLE 2

Synthesis of Compound (II-6)

18.5 g (0.05 moles) of 2-chloro-5 sec-hexadecylhydroquinone obtained by Synthesis Example 1 above was dissolved in 200 ml of ethyl acetate, to the resulting solution was added 22 g of manganese dioxide in powder form, and the mixture was stirred at 50° C. for 8 hours. After allowing to cool, manganese dioxide was removed by filtration from the reaction mixture and the filtrate was concentrated. The residue was purified by column chromatography (where the solvent was chloroform) to obtain 15 g of the desired compound, i.e., 2-chloro-5-sec-hexadecyl-1,4-benzoquinone as a yellow oily product. The structure of the compound was confirmed by NMR and mass spectrum.

Elemental Analysis:
Calculated for $C_{22}H_{35}ClO_2$: C:72.01, H:9.11,
Found: C:71.87, H:9.35.

The quinones represented by the formula (II) and the hydroquinones represented by the formula (III) according to the present invention can be employed individually or as a combination thereof. Further, they may be employed together with quinones and hydroquinones other than those according to the present invention, particularly those described in JP-A-63-316857.

The quinones represented by the formula (II) and/or the hydroquinones represented by the formula (III) according to the present invention are employed in a range preferably from 0.1 to 100 mol%, more preferably from 0.5 to 30 mol%, and most preferably from 1 to 20 mol%, per mole of the cyan coupler.

When the compound represented by the formula (II) and the compound represented by the formula (III) are employed in a mixture, a ratio of these compounds used is not critical. However, a molar ratio of the compound of the formula (II) to the compound of the formula (III) is preferably from 1:100 to 10:1.

The compound represented by the formula (II) or (III) can be added either directly to a coating solution for a photographic constituting layer containing the cyan coupler represented by the formula (I) or by first dissolving it in a solvent which does not adversely affect to the photographic light-sensitive material. Examples of such solvents include water or an alcohol. Also, the compound can be added by dissolving it in a solvent having a high boiling point and/or a solvent having a low boiling point and then emulsifying and dispersing the solution in an aqueous solution. Further, the compound can be employed by emulsifying and dispersing it together with the cyan coupler.

It is preferred that the hydroquinones and/or quinones according to the present invention are present together with the cyan coupler in same oil droplets.

The use of the specific hydroquinones and/or quinones according to the present invention is particularly effective in cases wherein developing agents are coexistent because of carry over from the preceding bath in a bleaching solution or a bleach-fixing solution.

The color photographic light-sensitive material according to the present invention may comprise a support having coated thereon at least one blue-sensitive silver halide emulsion layer, at least one green-sensitive silver halide emulsion layer and at least one red-sensitive silver halide emulsion layer. In the case of conventional color printing papers, the light-sensitive layers are usually provided on a support in the order as described above, but they can also be provided in a different order. Further, an infrared-sensitive silver halide emulsion layer may be employed in place of at least one of the above described emulsion layers. Each of the light-sensitive emulsion layers contains a silver halide emulsion having sensitivity in a respective wavelength region and a so-called color coupler which forms a dye of the complementary color to the light to which the silver halide emulsion is sensitive, that is, yellow, magenta and cyan to blue, green and red, respectively. Thus, color reproduction by a subtractive process can be performed. However, the relationship of the light-sensitive layer and hue of dye formed from the coupler may be varied in a different way from that described above.

Silver halide emulsions used in the present invention are preferably those comprising silver chlorobromide or silver chloride each containing substantially no silver iodide. The terminology "containing substantially no silver iodide" as used herein means that a silver iodide content of the emulsion is not more than 1 mol%, preferably not more than 0.2 mol%.

The halogen composition may be equal or different between individual grains in the emulsion. When an emulsion having an equal halogen composition between individual grains is used, it is easy to uniformly control the properties of the grains. Further, with respect to the distribution of the halogen composition inside the silver halide emulsion grains, grains having a so-called "uniform structure" wherein the halogen composition is equal at any portion of the grains, grains having a so-called "stratified structure" wherein the halogen composition of the interior (i.e., core) of grain is different from that of the shell (which includes one or more layers) surrounding the core, and grains having a structure wherein portions having different halogen compositions are present in the non-stratified form in the interior or on the surface of grains (i.e., the portion having a different composition being junctioned at an edge, corner or plane of the surface) can be appropriately selected. In order to obtain high sensitivity, it is advantageous to employ any of the two latter type grains rather than the uniform structure grains. They are also preferred in view of their resistance to pressure. In a case wherein silver halide grains have the different structures described above, the boundary of portions having different halogen compositions from each other may be either distinct or vague because of the formation of a mixed crystal due to the composition difference. Further, grains having an intentionally continuous change in structure may also be employed.

With respect to the halogen composition of a silver chlorobromide emulsion, any silver bromide/silver chloride ratio may be employed. The ratio may be widely varied depending on the purpose, but emulsions having a silver chloride content ratio of 2 mol% or more are preferably employed.

In photographic light-sensitive materials suitable for rapid processing, a so-called "high silver chloride content emulsion" which has a high silver chloride content ratio is preferably used. The silver chloride content ratio in a high silver chloride content emulsion is preferably 90 mol% or more, more preferably 95 mol% or more.

Of such high silver chloride content emulsions, those having a structure wherein a localized phase of silver bromide is present in the interior and/or on the surface of silver halide grains in the stratified form or in the non-stratified form as described above are preferred. With respect to the halogen composition of the localized phase described above, it is preferred that the silver bromide content is at least 10 mol%, and more preferably exceeding 20 mol%. The localized phase may exsist in the interior of the grain, or at the edge, corner or plane of the surface of the grain. One preferred example is a grain wherein epitaxial growth is made at the corner.

On the other hand, for the purpose of minimizing the reduction in sensitivity which occurs when pressure is applied to the photographic light sensitive material, it is also preferred to use uniform structure type grains, having a narrow distribution of the halogen composition even in a high silver chloride content emulsion having a silver chloride content of 90 mol% or more.

Further, for the purpose of reducing the amount of replenisher for a developing solution, the silver chloride content of a silver halide emulsion may be further increased. In such a case, an almost pure silver chloride is one wherein the silver chloride content is from 98 mol% to 100 mol%.

The average grain size of silver halide grains in the silver halide emulsion used in the present invention (the grain size being defined as a diameter of a circle having the same area as the projected area of the grain and being averaged by number) is preferably from 0.1 μm to 2 μm.

Moreover, it is preferred to employ a so-called monodispersed emulsion which has a grain size distribution such that the coefficient of variation (obtained by dividing the standard deviation of the grain size distribution with the average grain size) is not more than 20%, particularly not more than 15%. Further, it is preferred to employ two or more of the above described monodispersed emulsions as a mixture in the same layer or in the form of superimposed layers in order to obtain a wide latitude.

The silver halide grains contained in the photographic emulsion may have a regular crystal shape such as cubic, tetradecahedral, octahedral, etc., or an irregular crystal shape such as spherical, tabular, etc., or may have a composite form of these crystal shapes. Also, a mixture of grains having various crystal shapes may be used. Of these emulsions, those containing the grains having the above described regular crystal shape not more than 50%, preferably not more than 70%, and more preferably not more than 90% are advantageously used in the present invention.

Further, a silver halide emulsion wherein tabular silver halide grains having an average aspect ratio (i.e., the diameter of a corresponding circle/ thickness) at least 5, preferably at least 8, accounts for at least 50% of the total projected area of the silver halide grains may be preferably used in the present invention.

The silver chlorobromide emulsion used in the present invention can be prepared in any suitable manner, for example, by the methods as described in P. Glafkides, *Chemie et Physique Photoqraphique,* Paul Montel (1967), G.F. Duffin, *Photographic Emulsion Chemistry,* The Focal Press (1966), and V.L. Zelikman et al., *Making and Coating Photographic Emulsion,* The Focal Press (1964). That is, acid processes, neutral processes, and ammonia processes can all be employed.

Soluble silver salts and soluble halogen salts can be reacted by techniques such as a single jet, process, a double jet process, and a combination thereof. In addition, a method (a so-called "reversal mixing process") in which silver halide grains are formed in the presence of an excess of silver ions can also be employed. As one system of the double jet process, a so-called "controlled double jet process" in which the pAg in a liquid phase where silver halide is formed is maintained at a predetermined level can be employed. This process gives a silver halide emulsion in which the crystal form is regular and the grain size is nearly uniform.

During the step of formation or physical ripening of the silver halide grains of the silver halide emulsion used in the present invention, various kinds of multi-valent metal ion impurities can be introduced. Suitable examples of the compounds include cadmium salts, zinc salts, lead salts, copper salts, thallium salts, salts or complex salts of the Group VIII elements, for example, iron, ruthenium, rhodium palladium, osmium, iridium, and platinum. In particular, the above described Group VIII elements are preferably used. The amount of the compound added can be varied over a wide range depending on the purpose, but it is preferably used in a range from $10^{-9}$ to $10^{-2}$ mol per mol of silver halide.

The silver halide emulsions used in the present invention are usually subjected to chemical sensitization and spectral sensitization.

With respect to the chemical sensitization, a sulfur sensitization method (for example, the use of unstable sulfur compound), a noble metal sensitization method (for example, a gold sensitization method), and a reduction sensitization method are employed individually or in a combination. The compounds preferably used in the chemical sensitization include those as described in JP-A-62-215272, page 18, right lower column to page 22, right upper column.

The spectral sensitization is performed in order to impart spectral sensitivity in the desired wavelength range to the emulsion of each layer of the photographic light-sensitive material. According to the present invention, the spectral sensitization is conducted by adding a spectral sensitizing dye which is a dye capable of absorbing light of a wavelength range corresponding to the desired spectral sensitivity. Suitable examples of the spectral sensitizing dyes used include those as described, for example, in F.H. Harmer, *Heterocyclic compounds-Cyanine dyes and related compounds,* John Wiley & Sons (New York, London) (1964). Specific examples of the sensitizing dyes preferably employed are described in JP-A-62-215272, page 22, right upper column to page 38.

The silver halide emulsions used in the present invention can contain various kinds of compounds or precursors thereof for preventing the occurrence of fog or for stabilizing photographic performance during the production, storage and/or photographic processing of photographic light-sensitive materials. Specific examples of the compounds preferably used are described in JP-A-62-215272, page 39 to page 72.

The silver halide emulsion used in the present invention may be a so-called surface latent image type emulsion wherein latent images are formed mainly on the surface of grains or a so-called internal latent image type emulsion wherein latent images are formed mainly in the interior of grains.

In the color photographic light-sensitive material according to the present invention, a yellow coupler and a magenta coupler which form yellow and magenta colors respectively upon coupling with the oxidation product of an aromatic primary amine type color developing agent are ordinarily employed, in addition to the cyan coupler used in the present invention.

Magenta couplers and yellow couplers which are preferably used in the present invention include those represented by the following general formula (M-I), (M-II) or (Y):

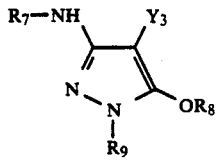

(M-I)

-continued

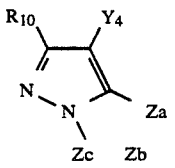

(M-II)

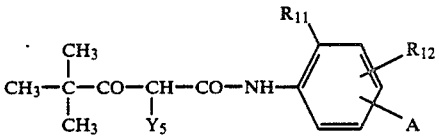

(Y)

In formula (M-I), $R_7$ and $R_9$ each represents an aryl group; $R_8$ represents a hydrogen atom, an aliphatic or aromatic acyl group or an aliphatic or aromatic sulfonyl group; and $Y_3$ represents a hydrogen atom or a releasing group.

The aryl group represented by $R_7$ or $R_9$ is preferably a phenyl group and may be substituted with one or more substituents which are selected from the substituents described with respect to $R_1$. When two or more substituents are present, they may be the same or different. $R_8$ is preferably a hydrogen atom, an aliphatic acyl group or an aliphatic sulfonyl group, and more preferably a hydrogen atom. $Y_3$ is preferably a releasing group which is released at any of a sulfur atom, an oxygen atom or a nitrogen atom, and more preferably a releasing group of a sulfur atom releasing type as described, for example, in U.S. Pat. No. 4,351,897 and International Laid Open No. WO 88/04795.

In the general formula (M-II), $R_{10}$ represents a hydrogen atom or a substituent; $Y_4$ represents a hydrogen atom or a releasing group, preferably a halogen atom or an arylthio group; Za, Zb and Zc each represents a methine group, a substituted methine group, =N— or —NH—, wherein one of the Za-Zb bond and the Zb-Zc bond is a double bond and the other is a single bond; when the Zb-Zc bond is a carbon-carbon double bond, the Zb-Zc bond may be a part of a condensed aromatic ring; $R_{10}$ or $Y_4$ may also form a polymer including a dimer or more; and when Za, Zb or Zc is a substituted methine group, the substituted methine group may form a polymer including a dimer or more.

Of the pyrazoloazole type couplers which are represented by formula (M-II), imidazo[1,2-b]pyrazoles as described in U.S. Pat. No. 4,500,630 are preferred and pyrazolo[1,5-b][1,2,4]triazoles as described in U.S. Pat. No. 4,540,654 are particularly preferred in view of the less yellow subsidiary adsorption and light fastness of dyes formed therefrom.

Further, pyrazolotriazole couplers having a branched alkyl group directly connected to the 2, 3 or 6 position of the pyrazolotriazole ring as described in JP-A-61-65245, pyrazoloazole couplers having a sulfonamido group in their molecules as described in JP-A-61-65246, pyrazoloazole couplers having an alkoxyphenylsulfonamido ballast group as described in JP-A-61-147254, and pyrazolotriazole couplers having an alkoxy group or an aryloxy group at the 6 position thereof as described in European Patent (OPI) Nos. 226,849 and 294,785 are also preferably employed.

In the general formula (Y), $R_{11}$ represents a halogen atom, an alkoxy group, a trifluoromethyl group or an aryl group; $R_{12}$ represents a hydrogen atom, a halogen atom or an alkoxy group; A represents $—NHCOR_{13}$, $—NHSO_2R_{13}$, $—SO_2NHR_{13}$, $—COOR_{13}$ or $$—SO_2N(R_{14})—R_{13}$$

wherein $R_{13}$ and $R_{14}$ each represents an alkyl group, an aryl group or an acyl group); and $Y_5$ represents a releasing group.

The group represented by $R_{12}$, $R_{13}$ or $R_{14}$ may be substituted with one or more substituents which are selected from the substituents described with respect to $R_1$. The releasing group represented by $Y_5$ is preferably a releasing group which is released at any of an oxygen atom or a nitrogen atom, and more preferably a releasing group of a nitrogen atom releasing type.

Specific examples of the couplers represented by formula (M-I), (M-II) or (Y) are illustrated below, but the present invention should not be construed as being limited thereto.

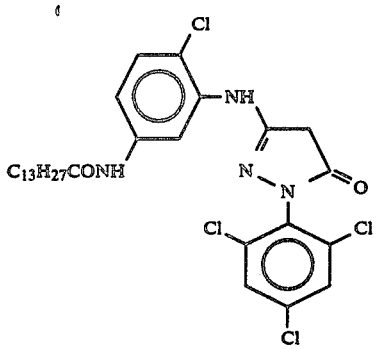

(M-1)

-continued
(M-2)
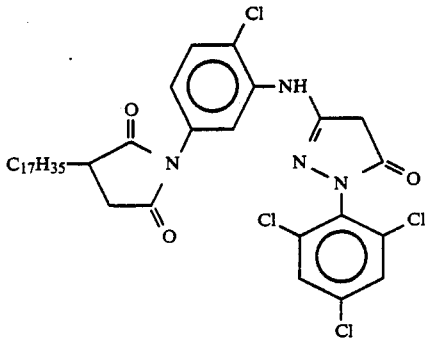
(M-3)
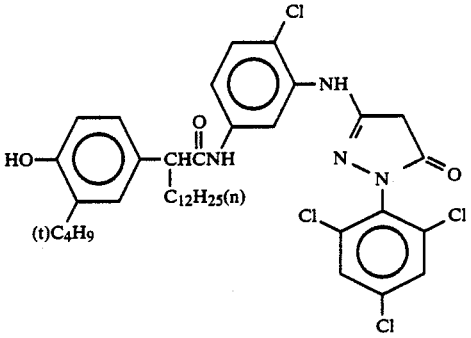
(M-4)
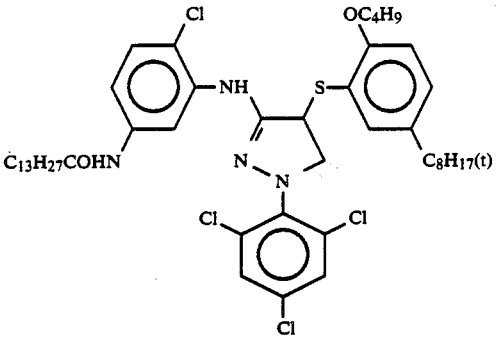
(M-5)
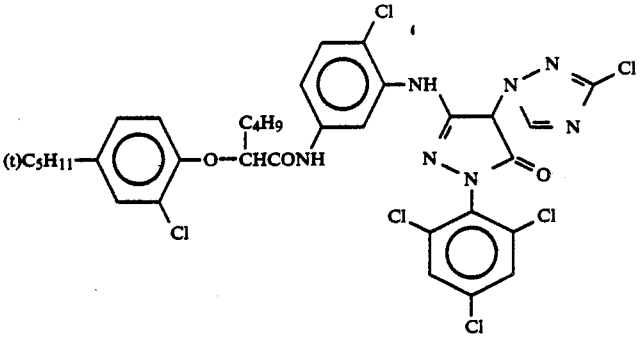

-continued
(M-6)
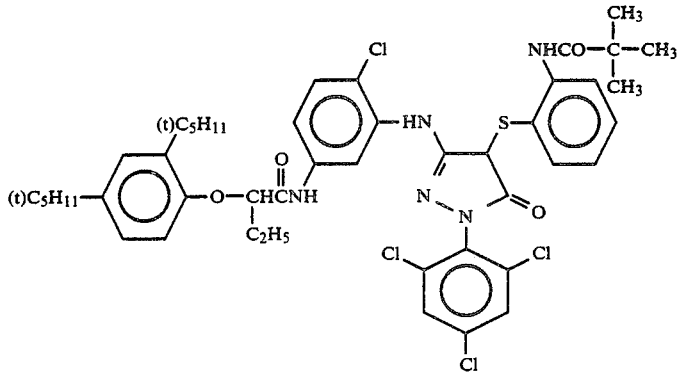
(M-7)
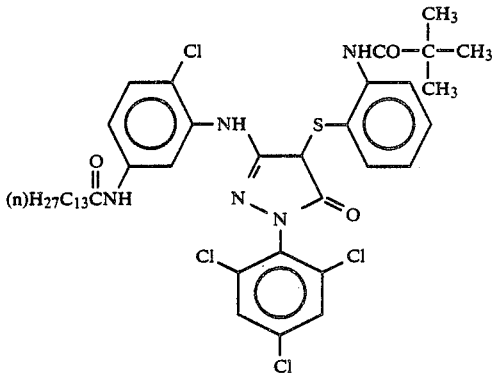
(M-8)
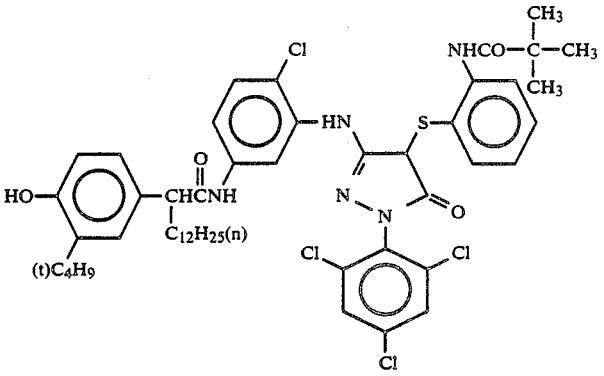

| Compound | $R_{10}$ | $R_{15}$ | $Y_4$ |
|---|---|---|---|
| | | 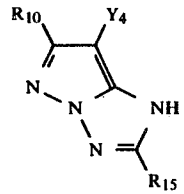 | |
| M-9 | $CH_3$— | 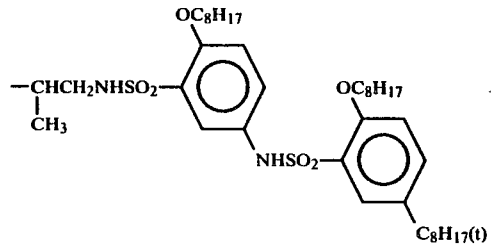 | Cl |
| M-10 | $CH_3$— | 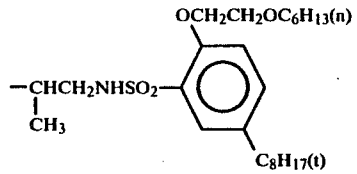 | Cl |
| M-11 | $(CH_3)_3C$— | 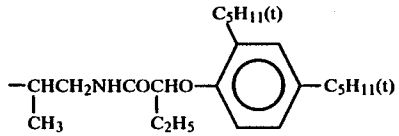 | 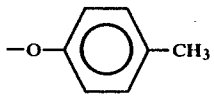 |
| M-12 | 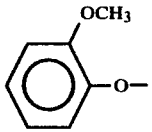 | 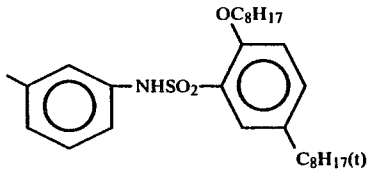 | 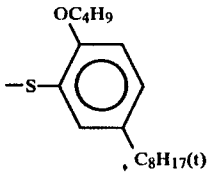 |

-continued
| Compound | $R_{10}$ | $R_{15}$ | $Y_4$ |
|---|---|---|---|
| M-13 | $CH_3$— | 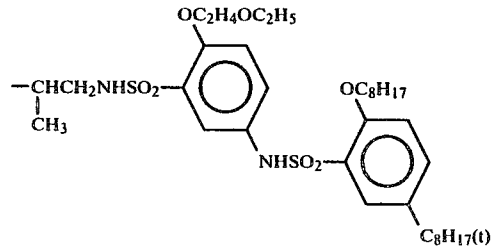 | Cl |
| M-14 | $CH_3$— | 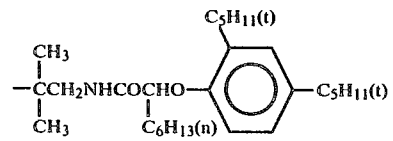 | Cl |
| M-15 | $CH_3$— | 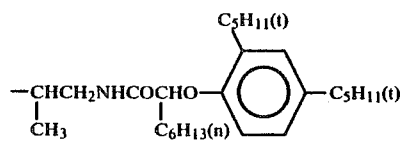 | Cl |
| M-16 | $CH_3$— | 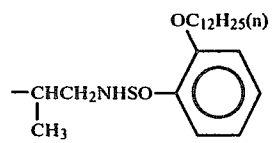 | Cl |
| M-17 | $CH_3$— | 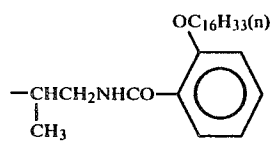 | Cl |

-continued
| Compound | $R_{10}$ | $R_{15}$ | $Y_4$ |
|---|---|---|---|
| M-18 | 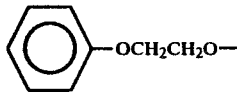 | 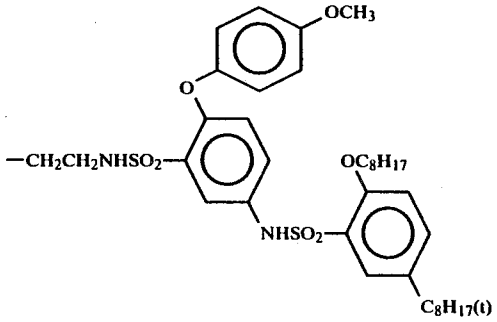 | 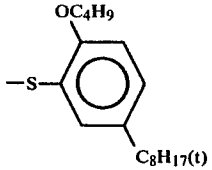 |
| M-19 | $CH_3CH_2O-$ | as above | as above |
| M-20 | 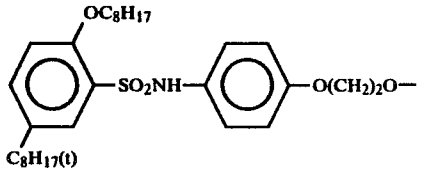 | 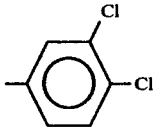 | 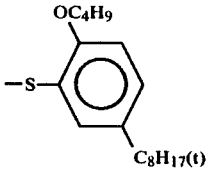 |
| M-21 | 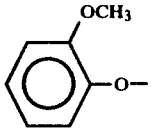 | 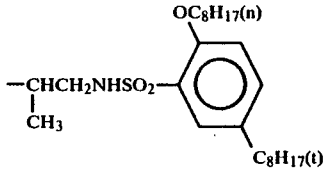 | Cl |
| | 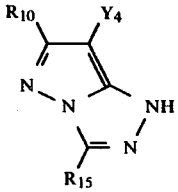 | | |
| M-22 | $CH_3-$ | 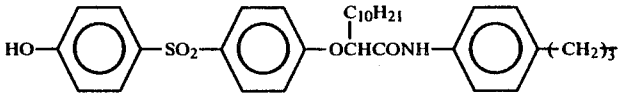 | Cl |

-continued

| Compound | $R_{10}$ | $R_{15}$ | $Y_4$ |
|---|---|---|---|
| M-23 | $CH_3-$ | $(n)C_8H_{17}$ \ $CHCH_2SO_2(CH_2)_2$ / $(n)C_8H_{17}$ | Cl |
| M-24 | $CH_3$ \ $CH-$ / $CH_3$ | $OC_4H_9$; $-SO_2(CH_2)_3$; $C_8H_{17}(t)$ | Cl |
| M-25 | $\leftarrow CH(COOCH_2CH_2OCH_3)-CH_2\rightarrow_{50}\leftarrow CH_2-C(CH_3)(CONH-)\rightarrow_{50}$ (Suffixes of parenthesis show weight ratio.) | $CH_3-CH(CH_2NHSO_2CH_3)-$ | Cl |
| M-26 | $-O-$ | $OC_8H_{17}$; $\leftarrow CH_2)_2NHSO_2-$; $C_8H_{17}(t)$ | Cl |
| M-27 | $CH_3-$ | $CH_3$; $CH_3$; $CH_3$; $NHCOCHO(n)C_{10}H_{21}-$; $-SO_2-$; $-OCH_2-$ | Cl |

-continued
| Compound | $R_{10}$ | $R_{15}$ | $Y_4$ |
|---|---|---|---|
| M-28 | $(CH_3)_3C-$ | 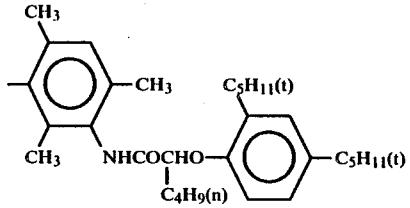 | Cl |
| M-29 | 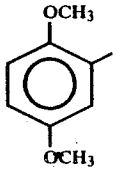 | 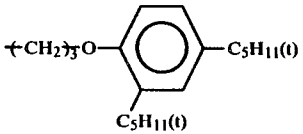 | Cl |
| M-30 | $CH_3-$ | $-CH(C_2H_5)-N(C_{18}H_{37}(n))COCH_2CH_2COOH$ | Cl |

(Y-1)
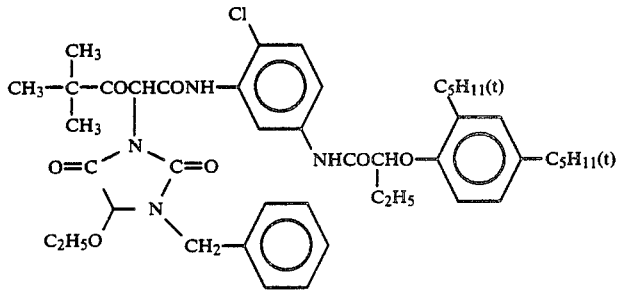
(Y-2)
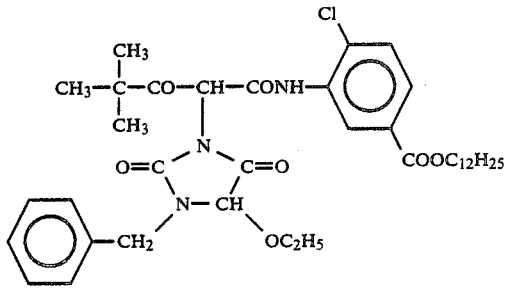
(Y-3)
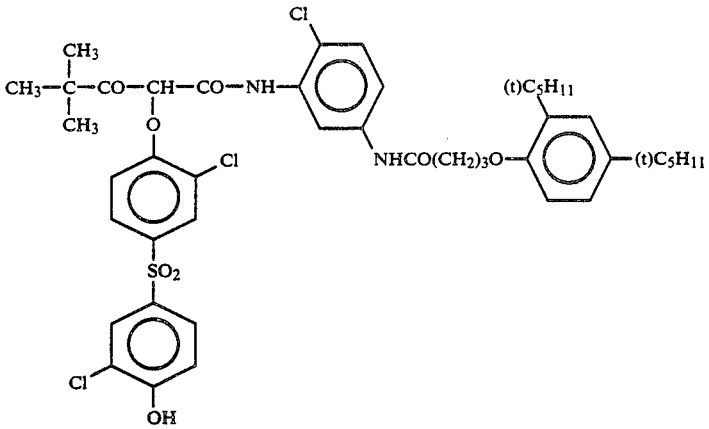
(Y-4)
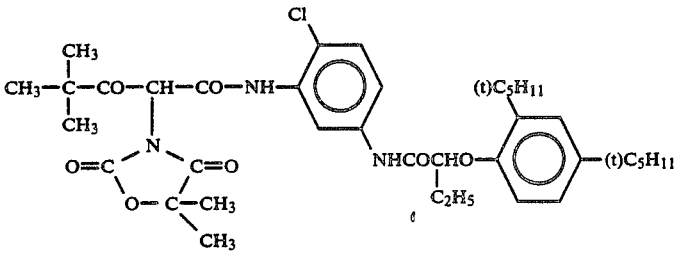
(Y-5)
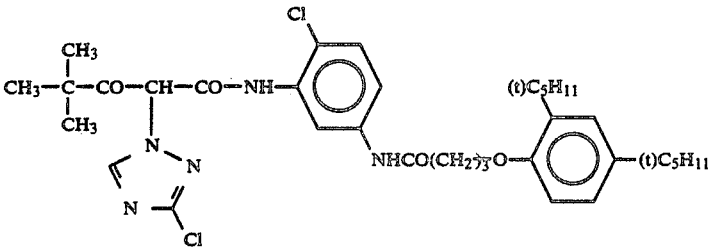

-continued (Y-6)

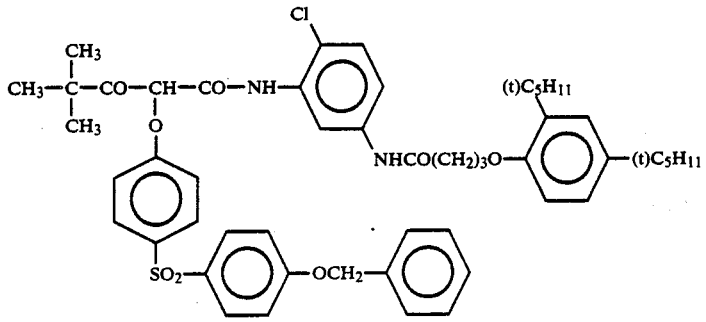

(Y-7)

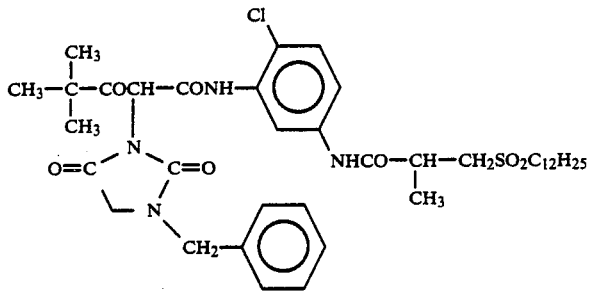

(Y-8)

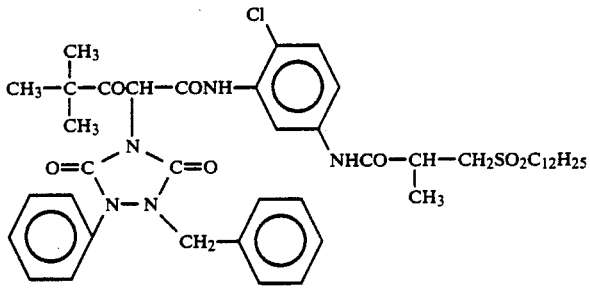

(Y-9)

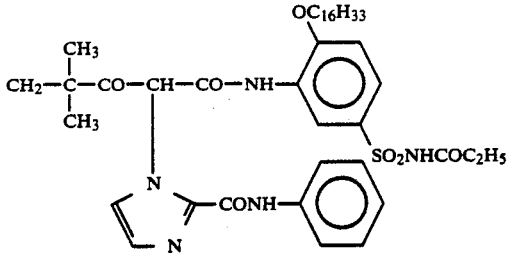

The coupler represented by formula (M-I), (M-II) or (Y) described above is incorporated into a silver halide emulsion layer which forms a light-sensitive layer in an amount ranging generally from 0.1 to 1.0 mole, preferably from 0.1 to 0.5 mole per mole of silver halide.

In the present invention, the above described couplers, may be added to light-sensitive silver halide emulsion layers by applying various known techniques. Usually, they can be added according to an oil-droplet-in-water dispersion method known as an oil protected process. For example, couplers are first dissolved in a solvent, and then emulsified and dispersed in a gelatin aqueous solution containing a surface active agent. Alternatively, water or a gelatin aqueous solution may be added to a coupler solution containing a surface active agent, followed by phase inversion to obtain an oil-droplet-in-water dispersion. Further, alkali-soluble couplers may also be dispersed according to a so-called Fischer's dispersion process. The coupler dispersion may be subjected to distillation, noodle washing, ultrafiltration, or the like to remove an organic solvent having a low boiling point and then mixed with a photographic emulsion.

As the dispersion medium of the couplers, an organic solvent having a high boiling point which has a dielectric constant of 2 to 20 (at 25° C.) and a refractive index of 1.5 to 1.7 (at 25° C.) and/or a waterinsoluble polymer compound is preferably employed.

Preferred examples of the organic solvent having a high boiling point used in the present invention include those represented by the following general formula (A), (B), (C), (D) or (E):

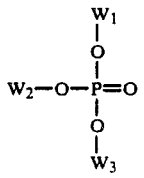

(A)

$W_1—COO—W_2$ (B)

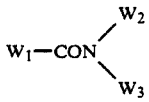

(C)

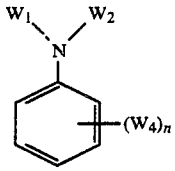

(D)

$W_1—O—W_2$ (E)

wherein $W_1$, $W_2$ and $W_3$ each represents a substituted or unsubstituted alkyl group, a substituted or unsubstitued cycloalkyl group, a substituted or unsubstituted alkenyl group, a substituted or unsubstituted aryl group or a substituted or unsubstituted heterocyclic group; $W_4$ represents $W_1$, —O—$W_1$ or —S—$W_1$; n represents an integer from 1 to 5, and when n is two or more, two or more $W_4$'s may be the same or different. In addition, $W_1$ and $W_2$ in formula (E) may form a condensed ring.

In addition to the solvents represented by formulae (A) to (E), any compound which has a melting point of 100° C. or lower and a boiling point of 140° C. or higher and which is immiscible with water and a good solvent for the coupler may be utilized as the high boiling point solvent in the present invention. The melting point of the organic solvent having a high boiling point is preferably not more than 80° C. The boiling point of the organic solvent having a high boiling point is preferably not less than 160° C., more preferably not less than 170° C.

Organic solvents having a high boiling point are described in detail in JP-A-62-215272, page 137, right lower column to page 144, right upper column.

Further, these couplers can be emulsified and dispersed in an aqueous solution of a hydrophilic colloid by loading them into a loadable latex polymer (such as those described in U.S. Pat. No. 4,203,716) in the presence of or in the absence of the above described organic solvent having a high boiling point, or dissolving them in a water-insoluble and organic solvent-soluble polymer.

Suitable examples of the polymers include homopolymers and copolymers as described in International Laid Open No. WO 88/00723, pages 12 to 30. In particular, acrylamide polymers are preferably used in view of improved color image stability.

The color photographic light-sensitive material according to the present invention may also contain a hydroquinone derivative, an aminophenol derivative, a gallic acid derivative, or an ascorbic acid derivative, as a color fog preventing agent, generally in an interlayer or a green-sensitive layer.

In the color photographic light-sensitive material according to the present invention, various color fading preventing agents can be employed. More specifically, representative examples of organic color fading preventing agents for cyan, magenta and/or yellow images include hindered phenols (for example, hydroquinones, 6-hydroxychromans, 5-hydroxycoumarans, spirochromans, p-alkoxyphenols, or bisphenols), gallic acid derivatives, methylenedioxybenzenes, aminophenols, hindered amines, or ether or ester derivatives thereof derived from each of these compounds by sililation or alkylation of the phenolic hydroxy group thereof. Further, metal complexes representatively illustrated by (bissalicylaldoxymate) nickel complex and (bis-N,N-dialkyldithiocarbamate) nickel complexes may be employed.

Specific examples of the organic color fading preventing agents are described in the following patents or patent applications.

Hydroquinones: U.S. Pat. Nos. 2,360,290, 2,418,613, 2,700,453, 2,701,197, 2,728,659, 2,732,300, 2,735,765, 3,982,944 and 4,430,425, British Patent 1,363,921, U.S. Pat. Nos. 2,710,801 and 2,816,028; 6-hydroxychromanes, 5-hydroxycoumarans and spirochromanes: U.S. Pat. Nos. 3,432,300, 3,573,050, 3,574,627, 3,698,909 and 3,764,337, JP-A-52-152225; spiroindanes: U.S. Pat. No. 4,360,589; p-alkoxyphenols: U.S. Pat No. 2,735,765, British Patent 2,066,975, JP A-59-10539, JP-B-57-19765; hindered phenols: U.S. Pat. No. 3,700,455, JP-A-52-72224, U.S. Pat. No. 4,228,235, JP-B-52-6623; gallic acid derivatives, methylenedioxybenzenes and aminophenols: U.S. Pat. Nos. 3,457,079 and 4,332,886, JP-B-56-21144; hindered amines: U.S. Pat. No. 3,336,135 and 4,268,593, British Patents 1,326,889, 1,354,313 and 1,410,846, JP-B-51-1420, JP-A-58-114036, JP-A-59-53846, JP-A-59-78344.

Further, specific examples of the metal complexes are described in U.S. Pat. Nos. 4,050,938 and 4,241,155, and British Patent 2,027,731(A).

The color fading preventing agent is co-emulsified with the corresponding color coupler in an amount of from 5 to 100% by weight of the color coupler and incorporated into the light-sensitive layer to achieve the effects thereof.

In order to prevent the degradation of the cyan dye image due to heat and particularly due to light, an ultraviolet light absorbing agent is introduced into a cyan color forming layer and/or both layers adjacent to the cyan color forming layer.

Suitable examples of the ultraviolet light absorbing agents used include aryl group-substituted benzotriazole compounds (for example, those as described in U.S. Pat. No. 3,533,794), 4-thiazolidone compounds (for example, those as described in U.S. Pat. Nos. 3,314,794 and 3,352,681), benzophenone compounds (for example, those as described in JP-A-46-2784), cinnamic acid ester compounds (for example, those as described in U.S. Pat. Nos. 3,705,805 and 3,707,395), butadiene compounds (for example, those as described in U.S. Pat. No. 4,045,229), and benzoxazole compounds. Furthermore, ultraviolet light absorptive couplers (for example, α-naphtholic cyan dye forming couplers) or ultraviolet light absorptive polymers may be used as ultraviolet light absorbing agents. These ultraviolet light absorbing agents may be mordanted in a specific layer.

Among these ultraviolet light absorbing agents, the aryl group-substituted benzotriazole compounds described above are preferred.

In accordance with the present invention, it is preferred to employ the compounds as described below together with the above described couplers, particularly the pyrazoloazole couplers. More specifically, a compound (F) which is capable of forming a chemical bond with the aromatic amine developing agent remaining after color development to give a chemically inactive and substantially colorless compound and/or a compound (G) which is capable of forming a chemical bond with the oxidation product of the aromatic amine developing agent remaining after color development to give a chemically inactive and substantially colorless compound are preferably employed in order to prevent the occurrence of stain and other undesirable side-effects due to the formation of colored dye upon a reaction of the color developing agent or oxidation product thereof which remains in the photographic layer with the coupler during preservation of the photographic material after processing. The compounds (F) and (G) may be employed individually or in combination.

Among the compounds (F), those capable of reacting at a second order reaction rate constant $k_2$ (in trioctyl phosphate at 80° C. ) with p-anisidine of from 1.0 liter/mol.sec. to $1\times10^{-5}$ liter/mol.sec. are preferred. The second order reaction rate constant can be measured by a method such as that described in JP-A-63-158545.

When the constant $k_2$ is larger than the upper limit of this range, the compounds per se are unstable and may apt to react with gelatin or water to decompose. On the other hand, when the constant $k_2$ is smaller than the lower limit of the above described range, the reaction rate in the reaction with the remaining aromatic amine developing agent is low, and as a result, the degree of prevention of the side-effect due to the remaining aromatic amine developing agent, tends to be reduced.

Of the Compounds (F), more preferred are those represented by the following general formula (FI) or (FII):

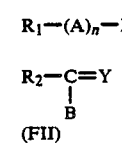

$$R_1-(A)_n-X \quad \text{(FI)}$$

$$R_2-\underset{\underset{B}{|}}{C}=Y \quad \text{(FII)}$$

(FII)

wherein $R_1$ and $R_2$ each represents an aliphatic group, an aromatic group or a heterocyclic group; n represents 0 or 1; A represents a group capable of reacting with an aromatic amine developing agent to form a chemical bond; X represents a group capable of being released upon the reaction with an aromatic amine developing agent; B represents a hydrogen atom, an aliphatic group, an aromatic group, a heterocyclic group, an acyl group or a sulfonyl group; Y represents a group capable of accelerating the addition of an aromatic amine developing agent to the compound represented by the general formula (FII); or $R_1$ and X, or Y and $R_2$ or B may combine with each other to form a cyclic structure.

A substitution reaction and an addition reaction are typical reactions for forming a chemical bond with the remaining aromatic amine developing agent.

Specific preferred examples of the compounds represented by formulae (FI) or (FII) are described, for example, in JP-A-63-158545, JP-A-62-283338, European Patent (OPI) Nos. 298,321 and 277,589.

On the other hand, of the Compounds (G) those more preferred are represented by the following general formula (GI):

$$R-Z \quad \text{(GI)}$$

wherein R represents an aliphatic group, an aromatic group or a heterocyclic group; and Z represents a nucleophilic group or a group capable of being decomposed in the photographic material to release a nucleophilic group.

Of the compounds represented by the general formula (GI), those wherein Z is a group having a Pearson's nucleophilic $^nCH_3I$ value of at least 5 (R.G. Pearson et al., *J. Am. Chem. Soc.*, Vol. 90, page 319 (1968)) or a group derived therefrom are preferred.

Specific preferred examples of the compounds represented by the general formula (GI) are described, for example, in European Patent (OPI}No. 255,722, JP-A-62-143048, JP-A-62-229145, Japanese Patent Application No. 63-136724 and JP-A-1-57259, European Patent (OPI) Nos. 298,321 and 277,589.

Further, combinations of Compound (G) and Compound (F) are described in detail in European Patent (OPI) No. 277,589.

The photographic light-sensitive material according to the present invention may contain water-soluble dyes or dyes which become water-soluble at the time of photographic processing as filter dyes or for irradiation or halation prevention or other various purposes in the hydrophilic colloid layers. Examples of such dyes include oxonol dyes, hemioxonol dyes, styryl dyes, merocyanine dyes, cyanine dyes, and azo dyes. 0f these dyes, oxonol dyes, hemioxonol dyes, and merocyanine dyes are most useful.

As binders or protective colloids which can be used for the emulsion layers of the color photographic light-sensitive material according to the present invention, gelatin is preferably used, but other hydrophilic colloids can be used alone or together wit gelatin.

As gelatin, lime-treated gelatin or acid-treated gelatin can be used in the present invention. Details of the production of gelatin are described in Arther Weiss, *The Macromolecular Chemistry of Gelatin*, published by Academic Press, 1964.

As the support those supports conventionally employed in photographic light-sensitive materials, for example, transparent films such as cellulose nitrate films and polyethylene terephthalate films, or reflective supports can be used. For the purpose of the present invention, reflective supports are preferably employed.

The term "reflective support" refers to those supports having an increased reflection property for the purpose of rendering dye images formed in the silver halide emulsion layer clear. Examples of reflective supports include supports having coated thereon a hydrophobic resin containing a light reflective substance such as titanium oxide, zinc oxide, calcium carbonate, or calcium sulfate dispersed therein and supports composed of a hydrophobic resin containing a light reflective substance dispersed therein. More specifically, they include baryta coated paper; polyethylene coated paper; polypropylene type synthetic paper; transparent supports, for example, a glass plate, a polyester film such as a polyethylene terephthalate film, a cellulose triacetate film or a cellulose nitrate film, a polyamide film, a polycarbonate film, a polystyrene film, or a vinyl chloride resin, having a reflective layer or having incorporated therein a reflective substance.

Other examples of reflective support which can be used are supports having a metal surface of mirror reflectivity or secondary diffuse reflectivity. The metal surface preferably has a spectral reflectance of 0.5 or more in the visible wavelength range. The metal surface is preferably produced by roughening or imparting diffusion reflectivity using metal powders. Suitable examples of metals include aluminum, tin, silver, magnesium or an alloy thereof. The metal surface includes a metal plate, a metal foil or a metal thin layer obtained by rolling, vacuum evaporation or plating. Among them, a metal surface obtained by vacuum evaporation of metal on other substrate is preferably employed.

On the metal surface it is preferred to provide a water-proof resin layer, particularly a thermoplastic resin layer. On the opposite side of the support to the metal surface, an antistatic layer is preferably provided. Details of these supports are described, for example, in JP-A-61-210346, JP-A-63-24247, JP A-63-24251 and JP-A-63-24255.

A suitable support can be appropriately selected depending on the purpose of use.

As the light reflective substance, white pigments thoroughly kneaded in the presence of a surface active agent are employed, and pigments the surface of which was treated with a divalent, trivalent or tetravalent alcohol are preferably used.

The occupied area ratio (%) per a definite unit area of fine white pigment particles can be determined in the following typical manner. Specifically, the area observed is divided into the unit area of 6 $\mu m \times 6$ $\mu m$ adjacent to each other, and the occupied area ratio (Ri) (%) of the fine particle projected on the unit area is measured. The coefficient of variation of the occupied area ratio (%) can be obtained by a ratio of $S/\bar{R}$ wherein S is a standard deviation of Ri and $\bar{R}$ is an average value of Ri. A number (n) of the unit area subject is preferably 6 or more. Thus, the coefficient of variation ($S/\bar{R}$) is obtained by the following equation:

$$\sqrt{\frac{\sum_{i=1}^{n}(Ri-\bar{R})^2}{n-1}} \Big/ \frac{\sum_{i=1}^{n} Ri}{n}$$

In the present invention, the coefficient of variation of the occupied area ratio (%) of fine pigment particles is preferably not more than 0.15, particularly preferably not more than 0.12. When the value is not more than 0.08, the dispersibility of particles can be designated as substantially uniform.

A color developing solution which can be used in development processing of the color photographic light-sensitive material is an alkaline aqueous solution preferably containing an aromatic primary amine type color developing agent as a main component. As the color developing agent, while an aminophenol type compound is useful, a p-phenylenediamine type compound is preferably employed. Typical examples of the p-phenylenediamine type compounds include 3-methyl-4- amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, or sulfate, hydrochloride or p-toluenesulfonate thereof.

Two or more kinds of color developing agents may be employed in a combination thereof, depending on the purpose.

The color developing solution can ordinarily contain pH buffering agents, such as carbonates or phosphates of alkali metals; and development inhibitors or anti-fogging agents such as bromides, iodides, benzimidazoles, benzothiazoles, or mercapto compounds. Further, if necessary, the color developing solution may contain various preservatives such as hydroxylamine, diethylhydroxylamine, sulfites, hydrazines, for example, N,N-biscarboxymethylhydrazine, phenylsemicarbazides, triethanolamine, or catechol sulfonic acids; organic solvents such as ethyleneglycol, or diethylene glycol; development accelerators such as benzyl alcohol, polyethylene glycol, quaternary ammonium salts, or amines; dye forming couplers; competing couplers; auxiliary developing agents such as 1-phenyl-3-pyrazolidone; viscosity imparting agents; and various chelating agents representatively illustrated by aminopolycarboxylic acids, aminopolyphosphonic acids, alkylphosphonic acids, or phosphonocarboxylic acids. Representative examples of the chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid), ethylenediamine-di(o-hydroxyphenylacetic acid), and salts thereof.

In case of conducting reversal processing, color development is usually conducted after black-and-white development and reversal processing. In a black-and-white developing solution, known black-and-white developing agents, for example, dihydroxybenzenes such as hydroquinone, 3-pyrazolidones such as 1-pheyl-3-pyrazolidone, or aminophenols such as N-methyl-p-aminophenol may be employed individually or in a combination.

The pH of the color developing solution or the black-and-white developing solution is usually in a range from 9 to 12. Further, an amount of replenishment for the developing solution can be varied depending on color photographic light-sensitive materials to be processed, but is generally not more than 3 liters per square meter of the photographic light-sensitive material. The amount of replenishment can be reduced to not more than 500 ml by decreasing a bromide ion concentration in the replenisher. In the case of reducing the amount of replenishment, it is preferred to prevent evaporation and aerial oxidation of the processing solution by means of reducing an area of a processing tank which is contact with the air.

The contact area of a photographic processing solution with the air in the processing tank can be represented by an opening rate as defined below.

$$\text{Opening Rate} = \frac{\text{Contact area of processing solution with the air (cm}^2\text{)}}{\text{Volume of processing solution (cm}^3\text{)}}$$

The opening rate described above is preferably not more than 0.1, more preferably from 0.001 to 0.05. Means for reducing the opening rate include a method using a movable cover as described in Japanese Patent Application No. 62-241342, a slit development processing method as described in JP-A-63-216050, in addition to a method wherein a shelter such as a floating cover is provided on the surface of a photographic processing solution in a processing tank.

It is preferred to apply the reduction of the opening rate not only to steps of color development and black and white development but also to all other subsequent steps, for example, bleaching, bleach-fixing, fixing, water washing and stabilizing. Further, the amount of replenishment can be reduced by using a means which restrain accumulation of bromide ions in the developing solution.

A processing time for the color development processing is usually selected in a range from 2 minutes to 5 minutes. However, it is possible to reduce the processing time by performing the color development at a high temperature and a high pH using a high concentration of the color developing agent.

After color development, the photographic emulsion layers are subjected to a bleach processing at a pH of not more than 6.3 in order to conduct the processing rapidly. The preferred pH is from 5.3 to 6.3, and the preferred temperature is from 28° to 40° C. The processing is conducted preferably within the range of from 15 to 60 seconds, and more preferably from 30 to 50 seconds. The bleach processing can be performed simultaneously with a fix processing (bleach-fix processing), or it can be performed independently from the fix processing. Further, for the purpose of a rapid processing, a processing method wherein after a bleach processing a bleach-fix processing is conducted may be employed. Moreover, it may be appropriately practiced depending on the purpose to process using a continuous two tank bleach-fixing bath, to carry out fix processing before bleach-fix processing, or to conduct bleach processing after bleach-fix processing.

Examples of bleaching agents which can be employed in the bleach processing or bleach-fix processing include compounds of a multivalent metal such as iron(III). Representative examples of the bleaching agents include organic complex salts of iron(III), for example, complex salts of aminopolycarboxylic acids (such as ethylenediaminetetraacetic acid, diethylenetriaminepentaacetic acid, cyclohexanediaminetetraacetic acid, methyliminodiacetic acid, 1,3-diaminopropanetetraacetic acid, or glycol ether diaminetetraacetic acid), or complex salts of citric acid, tartaric acid, or malic acid. Of these compounds, iron(III) complex salts of aminopolycarboxylic acids representatively illustrated by iron(III) complex salt of ethylenediaminetetraacetic acid are preferred in view of rapid processing and less environmental pollution associated with its use. Furthermore, iron(III) complex salts of aminopoly-carboxylic acids are particularly useful in both bleaching solutions and bleach-fixing solutions.

In the bleaching solution, the bleach-fixing solution or a prebath thereof, a bleach accelerating agent can be used, if desired. Specific examples of suitable bleach accelerating agents include compounds having a mercapto group or a disulfide bond as described, for example, in U.S. Pat. No. 3,893,858, West German Patent 1,290,812, JP-A-53-95630, and *Research Disclosure,* No. 17129 (July 1978); thiazolidine derivatives as described, for example, in JP-A-50-140129; thiourea derivatives as described, for example, in U.S. Pat. No. 3,706,561; iodides as described, for example, in JP-A-58-16235; polyoxyethylene compounds as described, for example, in West German Patent 2,748,430; polyamine compounds as described, for example, in JP-B45-8836; and bromide ions. Of these compounds, the compounds having a mercapto group or a disulfide group are preferred in view of their large bleach accelerating effects. Particularly, the compounds as described in U.S. Pat. No. 3,893,858, West German Patent 1,290,812 and JP-A-53-95630 are preferred. Further, the compounds as described in U.S. Pat. No. 4,552,834 are also preferred. These bleach accelerating agents may be incorporated into the color photographic light-sensitive material. These bleach accelerating agents are particularly effectively employed when color photographic light sensitive materials for photographing are subjected to bleach-fix processing.

As fixing agents which can be employed in the fixing solution or bleach-fixing solution, thiosulfates, thiocyanate, thioether compounds, thioureas, or a large amount of iodide are exemplified. Of these compounds, thiosulfates are generally employed. Particularly, ammonium thiosulfate is most widely employed. It is preferred to use sulfites, bisulfites, sulfinic acids such as p-toluenesulfinic acid, or carbonylbisulfite adducts as preservatives in the bleach-fixing solution.

After a desilvering step, the silver halide color photographic material according to the present invention is generally subjected to a water washing step and/or a stabilizing step.

An amount of water required for the water washing step may be set in a wide range depending on characteristics of photographic light-sensitive materials (due to the components used therein, for example, couplers, etc.), uses thereof, temperature of washing water, a number of water washing tanks (stages), a replenishment system such as countercurrent or co-current, or other various conditions. A relationship between a number of water washing tanks and an amount of water in a multi-stage countercurrent system can be determined based on the method as described in *Journal of the Society of Motion Picture and Television Engineers,* Vol. 64, pages 248 to 253 (May, 1955).

According to the multi-stage countercurrent system described in the above literature, the amount of water for washing can be significantly reduced. However, an increase in the staying time of water in a tank can cause propagation of bacteria as well as problems such as the adhesion of floatage formed on the photographic materials. In the method according to the present invention, a method for reducing amounts of calcium ions and magnesium ions as described in JP-A-62-288838 can be particularly effectively employed in order to solve such problems. Further, sterilizers, for example, isothiazolone compounds as described in JP-A57-8542, cyabendazoles, chlorine-containing sterilizers such as sodium chloroisocyanurate, benzotriazoles, sterilizers as described in Hiroshi Horiguchi, *Bokin-Bobai No Kagaku* (Sankyo Shuppan, 1986), *Biseibutsu No Mekkin-, Sakkin-, Bobai-Gijutsu,* edited by Eiseigijutsu Kai (Kogyogijutsu Kai, 1982), and *Bokin-Bobaizai Jiten,* edited by Nippon Bokin-Bobai Gakkai (1986) can be employed.

The pH of the washing water used in the processing of the photographic light-sensitive materials according to the present invention is usually from 4 to 9, preferably from 5 to 8. The temperature of the washing water and time for the water washing step can be set dependent upon the characteristics or uses of the photographic light-sensitive materials. However, a range of from 15° C. to 45° C. and a period from 20 sec. to 10 min. and preferably a range of from 25° C. to 40° C. and a period from 30 sec. to 5 min. is often employed.

The photographic light-sensitive material of the present invention can also be directly processed with a stabilizing solution in place of the above-described water washing step. In such a stabilizing process, any known methods such as those described, for example, in JP-A-57-8543, JP-A-58-14834 and JP-A-60-220345 can be employed.

Further, it is possible to conduct the stabilizing process subsequent to the above-described water washing process. One example thereof is a stabilizing bath containing formalin and a surface active agent, which is employed as a final bath in the processing of color photographic light-sensitive materials for photographing. Various chelating agents and antimolds may also be added to the stabilizing bath.

Overflow solutions resulting from the replenishment of the above-described washing water and/or stabilizing solution may be reused in other steps such as a desilvering step.

For the purpose of simplification and acceleration of processing, a color developing agent may be incorporated into the silver halide color photographic material according to the present invention. In order to incorporate the color developing agent, it is preferred to employ various precursors of color developing agents. Suitable examples of the precursors of developing agents include indoaniline type compounds as described in U.S. Pat. Nos. 3,342,597, Schiff's base type compounds as described in U.S. Pat. No. 3,342,599 and *Research Disclosure*, No. 14850 and *ibid.*, No. 15159, aldol compounds as described in *Research Disclosure*, No. 13924, metal salt complexes as described in U.S. Pat. No. 3,719,492, and urethane type compounds as described in JP-A-53-135628.

Further, the silver halide color photographic material according to the present invention may contain, if desired, various 1-phenyl-3-pyrazolidones for the purpose of accelerating color development. Typical examples of the compounds include those as described, for example in JP-A-56-64339, JP-A-57-144547, and JP-A-58-115438.

In the present invention, various kinds of processing solutions can be employed in a temperature range from 10° C. to 50° C. Although a standard temperature is from 33° C. to 38° C., it is possible to carry out the processing at higher temperatures in order to accelerate the processing whereby the processing time is shortened, or at lower temperatures in order to achieve an improvement in the image quality and to maintain the stability of the processing solutions.

Further, for the purpose of saving an amount of silver employed in the color photographic light-sensitive material, the photographic processing may be conducted utilizing color intensification using cobalt or hydrogen peroxide as described in West German Patent 2,226,770 or U.S. Pat. No. 3,674,499.

In accordance with the present invention, silver halide color photographic materials which have an excellent rapid processing aptitude provide cyan dye images prevented from inferior recoloring, and color balance of images formed is not destroyed after processing.

The present invention will be explained in greater detail with reference to the following examples, but the present invention should not be construed as being limited thereto.

EXAMPLE 1

On a paper support, both surfaces of which were laminated with polyethylene, layers were coated thereon as shown below to prepare a multilayer color printing paper which was designated Sample 101. The coating solutions were prepared in the following manner.

Preparation of Coatinq Solution for Fifth Layer 32.0 g of Cyan coupler (ExC), 17.0 g of Color image stabilizer (Cpd-6), 45.0 g of Solvent (Solv-6), and 40.0 g of Polymer (Cpd-7) were dissolved together with 140.0 ml of ethyl acetate and the resulting solution was emulsified and dispersed in 500 ml of a 18% aqueous solution of gelatin containing 65 ml of a 10% aqueous solution of sodium dodecylbenzenesulfonate. A red-sensitive sensitizing dye and a stabilizer as shown below were added to a silver chlorobromide emulsion (cubic grains, mixture of two emulsions having average grain size of 0.58 mμ and 0.45 mμ in 1:4 by molar ratio of silver, coefficient of variation of grain size: 0.09 and 0.11 respectively, 0.6 mol% silver bromide based on the whole of grains being localized at a part of the surface of grains respectively), and the emulsion was subjected to sulfur sensitization. The above described emulsified dispersion was mixed with the silver chlorobromide emulsion, with the concentration of the resulting mixture being controlled to form the composition shown below, whereby the coating solution for the fifth layer was prepared.

Coating solutions for the first layer to the seventh layer were prepared in a similar manner as described for the coating solution for the fifth layer.

1-Oxy-3,5-dichloro-s-triazine sodium salt was used as a gelatin hardener in each layer.

The following spectral sensitizing dyes were employed in the emulsion layers, respectively.

Blue-Sensitive Emulsion Layer:

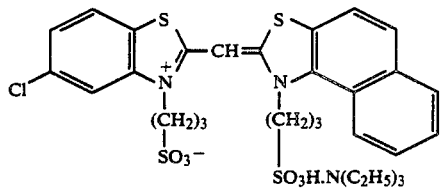

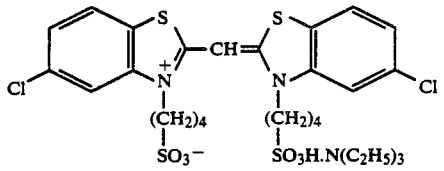

(Amount added: each $2.0\times10^{-}$mol per mol of silver halide in the larger grain size emulsion and each $2.5\times10^{-4}$ mol per mol of silver halide in the smaller grain size emulsion)

Green-Sensitive Emulsion Layer:

-continued

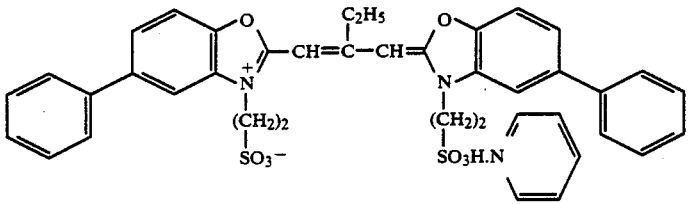

(Amount added: $4.0\times10^{-4}$ mol per mol of silver halide in the larger grain size emulsion and $5.6\times10^{-4}$ mol per mol of silver halide in the smaller grain size emulsion) and

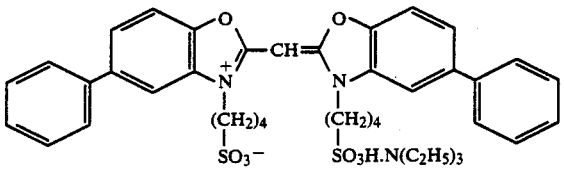

(Amount added: $7.0\times10^{-5}$ mol per mol of silver halide in the larger grain size emulsion and $1.0\times10^{-5}$ mol per mol of silver halide in the smaller grain size emulsion)

Red Sensitive Emulsion Layer:

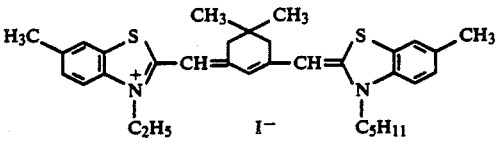

(Amount added: $0.9\times10^{-4}$ mol per mol of silver halide in the larger grain size emulsion and $1.1\times10^{-4}$ mol per mol of silver halide in the smaller grain size emulsion)

The compound shown below was added to the red-sensitive emulsion layer in an amount of $2.6\times10^{-3}$ mol per mol of silver halide.

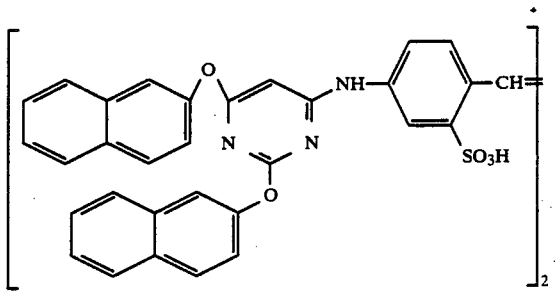

1-(5-methylureidophenyl)-5-mercaptotetrazole was added to the blue sensitive emulsion layer, green-sensitive emulsion layer and red sensitive emulsion layer in amounts of $8.5\times10^{-5}$ mol, $7.7\times10^{-4}$ mol and $2.5\times10^{-4}$ mol per of silver halide, respectively.

Moreover, in order to prevent irradiation, the following dyes were added to the emulsion layers.

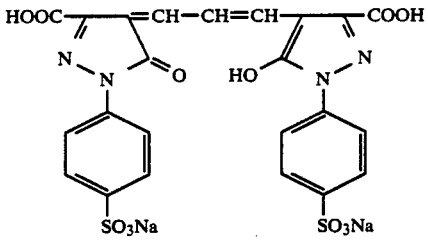

and

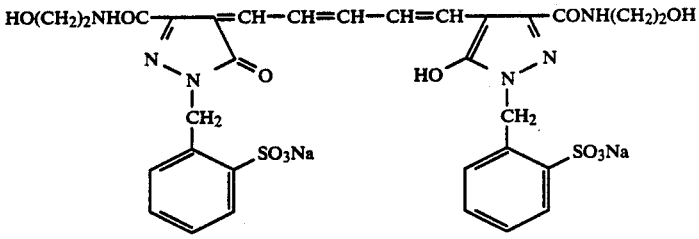

Layer Construction

The composition of each layer is shown below. The numerical values denote the coating amounts of components in the unit of g/m². The coating amount of silver halide emulsion is indicated in terms of silver coating amount.

| | | |
|---|---|---|
| Support | Polyethylene laminated paper (the polyethylene coating containing a white pigment ($TiO_2$) and a bluish dye (ultramarine) on the first layer side) | |
| First Layer (Blue-sensitive | The above-described silver chlorobromide emulsion | 0.30 |

-continued

| | | |
|---|---|---|
| layer) | Gelatin | 1.86 |
| | Yellow coupler (ExY) | 0.82 |
| | Color image stabilizer (Cpd-1) | 0.19 |
| | Solvent (Solv-3) | 0.35 |
| | Color image stabilizer (Cpd-7) | 0.06 |
| Second Layer (Color mixing preventing layer) | Gelatin | 0.99 |
| | Color mixing preventing agent (Cpd-5) | 0.08 |
| | Solvent (Solv-1) | 0.16 |
| | Solvent (Solv-4) | 0.08 |
| Third Layer (Green-Sensitive layer) | Silver chlorobromide emulsion (cubic grains, mixture of two emulsions having average grain size of 0.55 μm and 0.39 μm in 1:3 by molar ratio of silver, coefficient of variation of grain size: 0.10 and 0.08 respectively, 0.8 mol % silver bromide based on the whole of grains being localized at the surface of grains respectively) | 0.12 |
| | Gelatin | 1.24 |
| | Magenta coupler (ExM) | 0.20 |
| | Color image stabilizer (Cpd-2) | 0.03 |
| | Color image stabilizer (Cpd-3) | 0.15 |
| | Color image stabilizer (Cpd-4) | 0.02 |
| | Color image stabilizer (Cpd-9) | 0.02 |
| | Solvent (Solv-2) | 0.40 |
| | Solvent (Solv-7) | 0.18 |
| Fourth Layer (Ultraviolet light absorbing layer) | Gelatin | 1.58 |
| | Ultraviolet light absorbing agent (UV-1) | 0.47 |
| | Color mixing preventing agent (Cpd-5) | 0.05 |
| | Solvent (Solv-5) | 0.24 |
| Fifth Layer (Red-sensitive layer) | Silver chlorobromide emulsion (cubic grains, mixture of two emulsions having average grain size of 0.58 μm and 0.45 μm in 1:4 by molar ratio of silver, coefficient of variation of grain size: 0.09 and 0.11 respectively, 0.6 mol % silver bromide based on the whole of grains being localized at a part of the surface of grains) | 0.23 |
| | Gelatin | 1.34 |
| | Cyan coupler (ExC) | 0.32 |
| | Color image stabilizer (Cpd-6) | 0.17 |
| | Color image stabilizer (Cpd-7) | 0.40 |
| | Solvent (Solv-6) | 0.15 |
| Sixth Layer (Ultraviolet light absorbing layer) | Gelatin | 0.53 |
| | Ultraviolet light absorbing agent (UV-1) | 0.16 |
| | Color mixing preventing agent (Cpd-5) | 0.02 |
| | Solvent (Solv-5) | 0.08 |
| Seventh Layer (Protective layer) | Gelatin | 1.33 |
| | Acryl-modified polyvinyl alcohol copolymer (Degree of modification: 17%) | 0.17 |
| | Liquid paraffin | 0.03 |

The compounds used in the above-described layers have the chemical structures shown below respectively.

Yellow coupler (ExY)
A mixture of

-continued

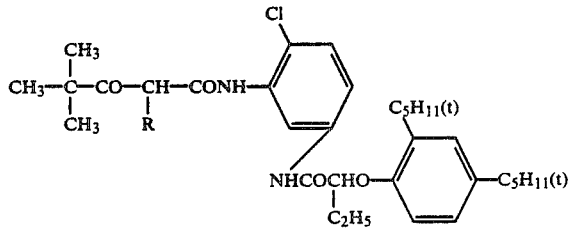

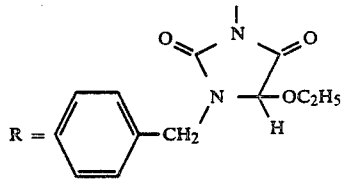

and

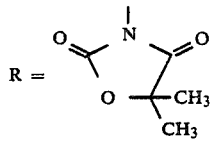

in a molar ratio of 1:1.

Magenta coupler (ExM)
A mixture of

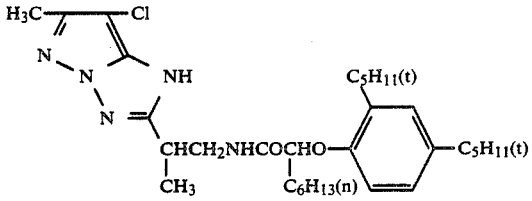

and

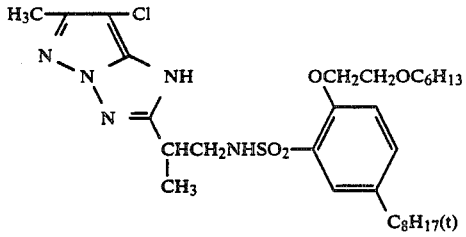

in a molar ratio of 1:1

Cyan coupler (ExC)
A mixture of

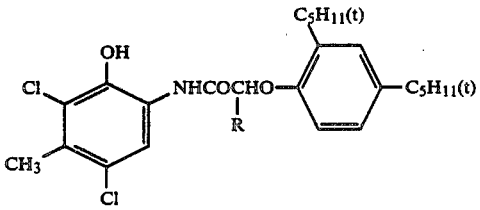

R = $C_2H_5$,
R = $C_4H_9$, and

-continued

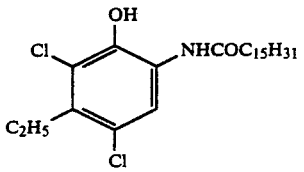

in a weight ratio of 2:4:4.

Color image stabilizer (Cpd-1)

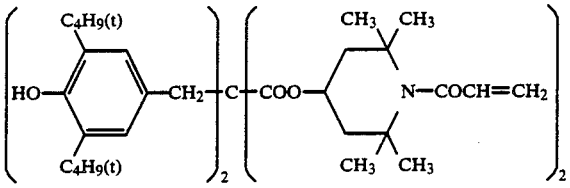

Color image stabilizer (Cpd-2)

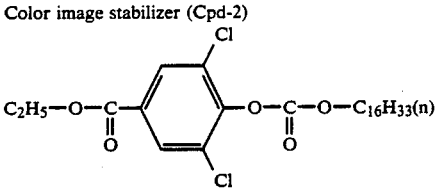

Color image stabilizer (Cpd-3)

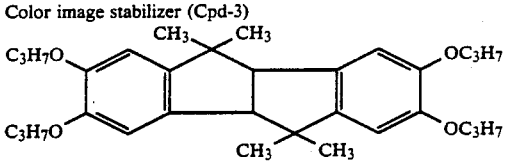

Color image stabilizer (Cpd-4)

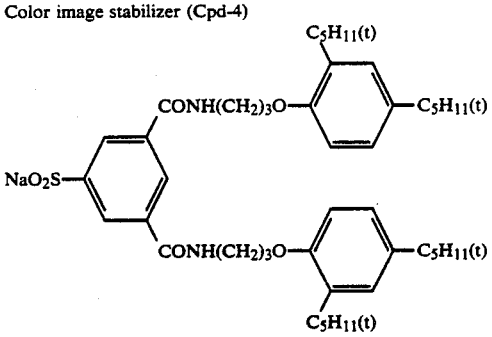

Color mixing preventing agent (Cpd-5)

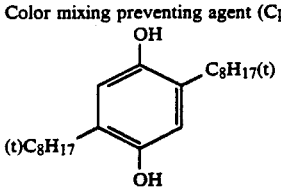

Color image stabilizer (Cpd-6)
A mixture of

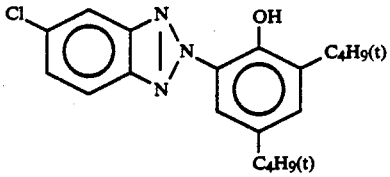

-continued

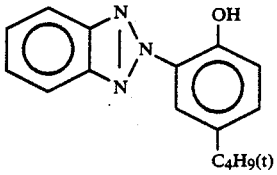

and

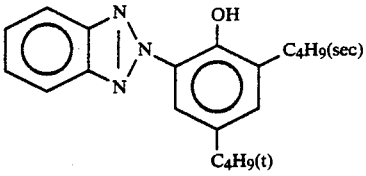

in a weight ratio of 2:4:4.

Color image stabilizer (Cpd-7)

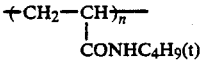

(average molecular weight: 60,000)

Color image stabilizer (Cpd-9)

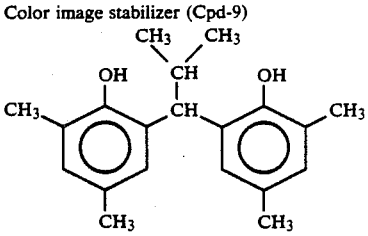

Ultraviolet light absorbing agent (UV-1)
A mixture of

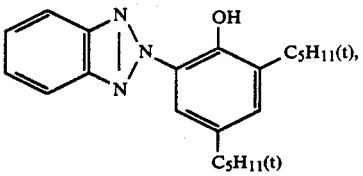

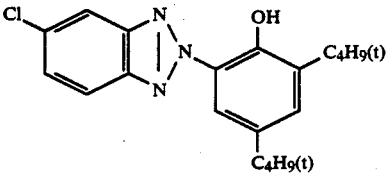

and

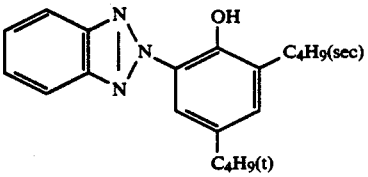

in a weight ratio of 4:2:4.

Solvent (Solv-1)

-continued

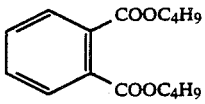

Solvent (Solv-2)
A mixture of

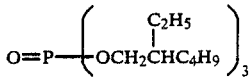

and

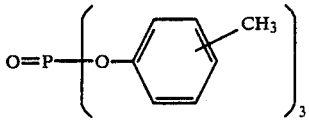

in a volume ratio of 2:1

Solvent (Solv-3)
$O{=}P{\leftarrow}O{-}C_9H_{19}(iso))_3$

Solvent (Solv-4)

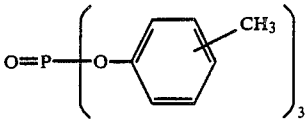

Solvent (Solv-5)

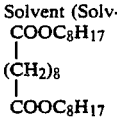

Solvent (Solv-6)

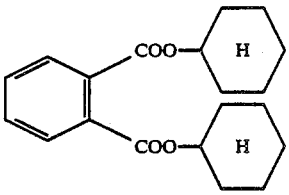

Solvent (Solv-7)

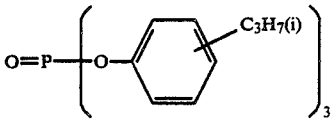

(Reofos 95 manufactured by Ajinomoto Co., Inc.)

Samples 102 to 117 were prepared in the same manner as described for Sample 101 above except that the compound represented by the formula (II) or (III), or a quinone compound or a hydroquinone compound other than those represented by formula (II) or (III), was added to the firth layer, i.e., red-sensitive layer, of Sample 101, respectively (in an amount of 20 mol% to the cyan coupler). Each of these compounds was emulsified by dispersing it into the emulsified dispersion containing the cyan coupler in the same manner as for the cyan coupler Each of the thus-prepared samples was subjected to wedge exposure for sensitometry using a sensitometer (FWH type, produced by Fuji Photo Film Co., Ltd.) equipped a light source having a color temperature of 3,200° K. The amount of exposure was 250 CMS and the exposure time was 1/10 second.

The exposed sample was subjected to color development processing by an automatic developing machine according to the processing steps and using the processing solutions shown below. The bleach-fixing step was conducted at four kinds of pH values. The pH of the bleach-fixing solution was set up as follows:

A : 5.5
B : 6.0
C : 6.3
D : 6.8

| Processing Step | Temperature (°C.) | Time |
|---|---|---|
| Color development | 35 | 45 sec. |
| Bleach-Fixing | 30 to 35 | 45 sec. |
| Washing with Water (1) | 30 to 35 | 20 sec. |
| Washing with Water (2) | 30 to 35 | 20 sec. |
| Washing with Water (3) | 30 to 35 | 20 sec. |
| Drying | 70 to 80 | 60 sec. |

The water washing steps were conducted using a three-tank countercurrent system from Washing with Water (3) to Washing with Water (1).

The composition of each processing solution used was as follows:

| | |
|---|---|
| Color Developing Solution: | |
| Water | 800 ml |
| Ethylenediamine N,N,N',N'-tetra-methylenephosphonic acid | 1.5 g |
| Triethanolamine | 10 g |
| Sodium Chloride | 1.4 g |
| Potassium Carbonate | 25 g |
| N-Ethyl-N-(β-methanesulfonamidoethyl)-3-methyl-4-aminoaniline sulfate | 5.0 g |
| N,N-Bis(carboxymethyl)hydrazine | 5.0 g |
| Fluorescent brightening agent (WHITEX 4 manufactured by Sumitomo Chemical Co., Ltd.) | 2.0 g |
| Water to make | 1,000 ml |
| pH (25° C.) | 10.10 |
| Bleach-Fixing Solution: | |
| Water | 400 ml |
| Ammonium Thiosulfate Solution (700 g/l aqueous solution) | 100 ml |
| Sodium Sulfite | 18 g |
| Ammonium Iron(III) Ethylenediamine-tetraacetate | 55 g |
| Disodium Ethylenediaminetetraacetate | 3 g |
| Ammonium Bromide | 40 g |
| Water to make | 1,000 ml |
| pH (25° C.) Adjusted at the above-described value with glacial acetic acid | |

Water Washing Solution

City water was pass through a mixed bed type column filled with an H type strong acidic cation exchange resin (Amberlite IR-120B manufactured by Rhom & Haas Co.) and an OH type strong basic anion exchange resin (Amberlite IRA-400 manufactured by Rhom & Haas Co.) to prepare water containing not more than 3 mg/l of calcium ion and magnesium ion. Sodium dichloroisocyanulate in an amount of 20 mg/l and sodium sulfate in an amount of 150 mg/l were added to the treated water. The pH of the solution was in a range from 6.5 to 7.5.

With the samples thus-obtained, Evaluations 1 to 3 shown below were conducted.

Evaluation 1

The cyan density of the color image in each sample was measured by a Fuji-Densitometer (Mod-8509 type). Then, the samples were subjected to the oxidation treatment described below.

| Oxidation Treatment: | | |
|---|---|---|
| Processing Step | Temperature (°C.) | Time |
| Oxidation Bath | 38 | 5 min. |
| Washing with water | 15 to 23 | 10 min. |
| Drying | 70 to 80 | 50 sec. |

| Oxidation Bath: | |
|---|---|
| Potassium ferricyanide | 5 g |
| Water to make | 1,000 ml |

After the oxidation treatment, the cyan density of each sample was again measured. A cyan density before the oxidation treatment at the point which provided a cyan density of 2.00 after the oxidation treatment was measured and a degree of inferior recoloring was determined by the comparison of the cyan density before the oxidation treatment with the cyan density after the oxidation treatment.

Evaluation 2

Each sample processed with a bleach-fixing solution having a pH of 6.3 was subjected to a color fading test using a color fading tester with a xenon lamp (about 150,000 lux) for 24 hours. A cyan density after the fading test at the point which had a cyan density of 2.00 just after the processing was measured and the difference between these cyan densities was determined.

Evaluation 3

The remained silver amount at the maximum density of the image was measured by a fluorescent X-ray method to evaluate the degree of breach-fixing proceedings.

The results of Evaluations 1 to 3 are shown in Tables 1 and 2 below.

TABLE 1

| Sample No. | Compound Added to Fifth Layer | Degree of Inferior Recoloring pH of Bleaching-Fixing Solution 5.5 | 6.0 | 6.3 | 6.8 | Degree of Light Fading |
|---|---|---|---|---|---|---|
| 101 | — | 0.17 | 0.12 | 0.08 | 0.04 | 0.08 |

TABLE 1-continued

| Sample No. | Compound Added to Fifth Layer | Degree of Inferior Recoloring pH of Bleaching-Fixing Solution 5.5 | 6.0 | 6.3 | 6.8 | Degree of Light Fading |
|---|---|---|---|---|---|---|
| 102 | Comparative Compound (A) | 0.17 | 0.13 | 0.08 | 0.04 | 0.24 |
| 103 | Comparative Compound (B) | 0.05 | 0.04 | 0.04 | 0.02 | 0.15 |
| 104 | Comparative Compound (C) | 0.06 | 0.04 | 0.04 | 0.04 | 0.22 |
| 105 | Comparative Compound (D) | 0.17 | 0.13 | 0.08 | 0.04 | 0.25 |
| 106 | Comparative Compound (E) | 0.13 | 0.10 | 0.07 | 0.03 | 0.17 |
| 107 | Comparative Compound (F) | 0.06 | 0.04 | 0.04 | 0.04 | 0.21 |
| 108 | Compound (II-1) | 0.03 | 0.03 | 0.02 | | |
| 109 | Compound (II-3) | 0.05 | 0.04 | 0.03 | | |
| 110 | Compound (II-6) | 0.02 | 0.03 | 0.02 | | |
| 111 | Compound (II-9) | 0.05 | 0.04 | 0.03 | | |
| 112 | Compound (III-2) | 0.04 | 0.03 | 0.02 | | |
| 113 | Compound (III-4) | 0.05 | 0.04 | 0.03 | | |
| 114 | Compound (III-6) | 0.03 | 0.03 | 0.02 | | |
| 115 | Compound (III-9) | 0.05 | 0.04 | 0.03 | | |
| 116 | Compound (III-16) | 0.05 | 0.04 | 0.03 | | |
| 117 | Compound (III-20) | 0.05 | 0.04 | 0.03 | | |

(* The results shown in the box were obtained in the methods according on the present invention.)

TABLE 2

| Sample No. | Remained Silver Amount after Processing ($\mu g/cm^2$) pH of Bleach-Fixing Solution 5.5 | 6.0 | 6.3 | 6.8 |
|---|---|---|---|---|
| 101 | 2.4 | 2.6 | 2.8 | 4.7 |
| 102 | 2.4 | 2.7 | 2.9 | 4.7 |
| 103 | 2.5 | 2.7 | 2.8 | 4.6 |
| 104 | 2.4 | 2.7 | 2.9 | 4.8 |
| 105 | 2.5 | 2.6 | 2.8 | 4.7 |
| 106 | 2.4 | 2.5 | 2.8 | 4.7 |
| 107 | 2.4 | 2.7 | 2.8 | 4.8 |
| 108 | 2.3 | 2.5 | 2.7 | 4.5 |
| 109 | 2.3 | 2.6 | 2.9 | 4.7 |
| 110 | 2.5 | 2.6 | 2.9 | 4.8 |
| 111 | 2.4 | 2.7 | 2.9 | 4.6 |
| 112 | 2.5 | 2.7 | 2.8 | 4.7 |
| 113 | 2.4 | 2.7 | 2.8 | 4.8 |
| 114 | 2.4 | 2.6 | 2.9 | 4.7 |
| 115 | 2.3 | 2.5 | 2.9 | 4.6 |
| 116 | 2.3 | 2.7 | 2.8 | 4.6 |
| 117 | 2.4 | 2.7 | 2.9 | 4.7 |

(* The results shown in the box were obtained in the method according on the present invention.)

The compound added to the fifth layer was used in an amount of 20 mol% to the cyan coupler.

Comparative Compound (A):

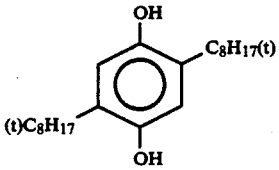

Comparative Compound (B):

-continued

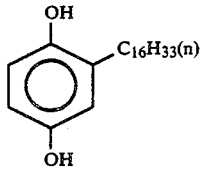

(Compound described in JP-A-63-316857)

Comparative Compound (C):

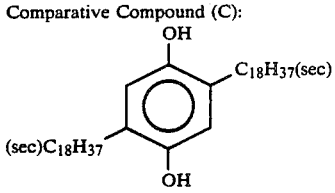

(Compound described in JP-A-63-316857)

Comparative Compound (D):

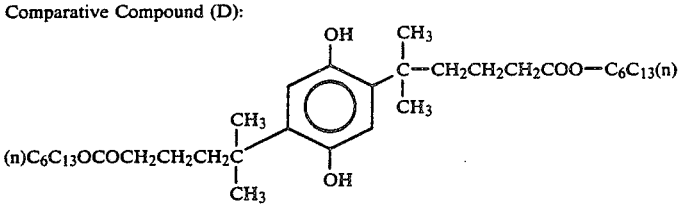

Comparative Compound (E):

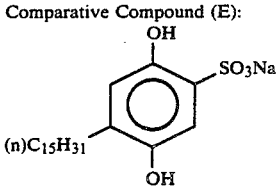

Comparative Compound (F):

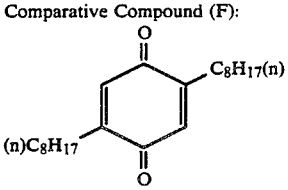

(Compound described in JP-A-63-316857)

From the results shown in Table 1, it can be seen that with the sample which does not contain a hydroquinone and/or quinone compound, the inferior recoloring increases as the pH of the bleach-fixing solution decreases. In the examples employing the compound described in JP-A-63-316857, i.e., Comparative Compounds (B), (C) and (F), although the inferior recoloring can be reduced, there is a problem in that the light fading remarkably increases as compared with the case containing no such compound. Further, hydroquinone compounds other than those according to the present invention exhibit only a slight effectiveness in preventing the inferior recoloring and large light fading. On the contrary, when the compound of the formula (II) or (III) according to the present invention is employed, a sufficient effect for preventing the inferior recoloring can be obtained and light fading does not substantially increases.

When cyan couplers represented by the formula (I) according to the present invention other than ExC described above were used, the same results as above are obtained.

EXAMPLE 2

Samples 201 to 217 were prepared in the same manner as described for Samples 101 to 117 in Example 1 except for changing the amount of the hydroquinone compound or the quinone compound to 10 mol% to the cyan coupler.

The samples were exposed to light in the same manner as described in Example 1 and then subjected to a continuous processing (i.e., running test) by an automatic developing machine for paper according to the processing steps and using the processing solution shown below until the amount of replenishment reached an amount which was twice the tank capacity of the color developing solution.

| Processing Step | Temperature (°C.) | Time | Amount of* Replenishment (ml) | Tank Capacity (l) |
|---|---|---|---|---|
| Color Development | 38 | 45 sec. | 109 | 4 |
| Bleach-Fixing | 30–36 | 45 sec. | 215 | 4 |
| Rinse (1) | 30–37 | 20 sec. | — | 2 |
| Rinse (2) | 30–37 | 20 sec. | — | 2 |

-continued

| Processing Step | Temperature (°C.) | Time | Amount of* Replenishment (ml) | Tank Capacity (l) |
|---|---|---|---|---|
| Rinse (3) | 30–37 | 20 sec. | 364 | 2 |
| Drying | 70–85 | 60 sec. | | |

*The amount of replenishment per $m^2$ of photographic light-sensitive material

The rinse steps were conducted using a three-tank countercurrent system from Rinse (3) to Rinse (1).

The composition of each processing solution used is illustrated below.

| | Tank Solution | Replenisher |
|---|---|---|
| Color Developing Solution: | | |
| Water | 800 ml | 800 ml |
| Ethylenediamine-N,N,N',N'-tetramethylenephosphonic acid | 5.0 g | 5.0 g |
| 5,6-Dihydroxybenzene-2,4-disulfonic acid | 0.5 g | 0.5 g |
| Triethanolamine | 8.0 g | 8.0 g |
| Sodium chloride | 2.4 g | — |
| Potassium bromide | 0.015 g | — |
| Potassium carbonate | 25 g | 25 g |
| N-Ethyl-N-(β-methanesulfonamidoethyl)-3-methyl-4-aminoaniline sulfate | 5.0 g | 9.5 g |
| N,N-Bis(carboxymethyl)hydrazine | 0.03 mol | 0.03 mol |
| Sodium sulfite | 0.02 g | 0.02 g |
| Fluorescent brightening agent (WHITEX 4 manufactured by Sumitomo Chemical Co., Ltd., diaminostilbene type) | 1.0 g | 2.5 g |
| Water to make | 1000 ml | 1000 ml |
| pH (at 25° C.) | 10.05 | 10.05 |
| Bleach-Fixing Solution: (both Tank Solution and Replenisher) | | |
| Water | 400 ml | |
| Ammonium thiosulfate (700 g/l aqueous solution) | 100 ml | |
| Ammonium sulfite | 17 g | |
| Ammonium Iron (III) ethylenediaminetetraacetate | 55 g | |
| Disodium ethylenediaminetetraacetate | 5 g | |
| Glacial acetic acid | 9 g | |
| Ammonium bromide | 30 g | |
| Water to make | 1000 ml | |
| pH (at 25° C.) | 5.40 | |
| Rinse Solution: (both Tank Solution and Replenisher) | | |
| Ion-exchanged water (calcium and magnesium contents: not more than 3 ppm respectively) | | |

Evaluation 1 as described in Example 1 was conducted with these samples. The results obtained are shown in T able 3 below.

TABLE 3

| Sample No. | Degree of Inferior Recoloring | Remark |
|---|---|---|
| 201 | 0.18 | Comparison |
| 202 | 0.17 | " |
| 203 | 0.07 | " |
| 204 | 0.07 | " |
| 205 | 0.18 | " |
| 206 | 0.14 | " |
| 207 | 0.07 | " |
| 208 | 0.03 | Present Invention |
| 209 | 0.04 | Present Invention |
| 210 | 0.02 | Present Invention |
| 211 | 0.04 | Present Invention |
| 212 | 0.03 | Present Invention |
| 213 | 0.04 | Present Invention |
| 214 | 0.02 | Present Invention |
| 215 | 0.04 | Present Invention |
| 216 | 0.04 | Present Invention |
| 217 | 0.04 | Present Invention |

From the results shown in Table 3 above, it is apparent that the inferior recoloring is prevented when the compound according to the present invention are employed even when a running processing is performed using a bleach-fixing solution of a low pH.

EXAMPLE 3

Samples 218 to 223 were prepared in the same manner as described for Sample 101 in Example 1 except that the cyan coupler in the fifth layer (red-sensitive layer) in Sample 101 was replaced with an equimolar of each of the cyan couplers shown in Table 4.

Furthermore, Samples 224 to 229 were prepared in the same manner as Samples 218 to 223 except that Compound (III-21) was further added to the fifth layer of each Sample.

The thus obtained Samples were exposed and subjected to color development wherein bleach-fixing solutions having a pH of 6.8 and 6.0, respectively, were used.

Each of Samples was evaluated according on Evaluations 1 and 3 described in Example 1. The results thus obtained are shown in Table 4.

TABLE 4

| Sample No. | Coupler in 5th Layer | (III-21) in 5th Layer | Degree of Inferior of Recoloring/Remained Ag Amount (μg/cm²) pH = 6.0 | pH = 6.8 |
|---|---|---|---|---|
| 218 | C-2 | none | 0.12/2.7 | 0.03/4.6 |
| 219 | C-4 | " | 0.14/2.6 | 0.04/4.7 |
| 220 | C-10 | " | 0.08/2.6 | 0.03/4.8 |
| 221 | C-11 | " | 0.07/2.4 | 0.03/4.7 |
| 222 | C-24 | " | 0.05/2.5 | 0.03/4.8 |
| 223 | C-26 | " | 0.06/2.7 | 0.03/4.8 |
| 224 | C-2 | used | 0.03/2.6* | 0.02/4.7 |
| 225 | C-4 | " | 0.04/2.6 | 0.03/4.8 |
| 226 | C-10 | " | 0.03/2.7 | 0.03/4.7 |
| 227 | C-11 | " | 0.03/2.5 | 0.03/4.7 |
| 228 | C-24 | " | 0.02/2.4 | 0.02/4.9 |
| 229 | C-26 | " | 0.02/2.6 | 0.02/4.7 |

(* Results shown in the box were obtained in the method according on the present invention)

From the results shown in Table 4, it can be seen that only when bleach-fixing is conducted using a bleach-fixing solution containing Compound (III-21) and having a pH of 6.0, an excellent image with small inferior of recoloring and a small amount of the remained silver can be obtained. Furthermore, it can also be seen that a cyan coupler having a —NHCO— group as Y in formula (I) provides remarkable effects of the present invention, and when the coupler further having an alkyl group as $R_2$ provides more remarkable effects.

Inferior of light fading due to the addition of Compound (III-21), which was evaluated by the method of Evaluation 2 could not be observed regardless of the type of the cyan coupler of the present invention.

While the invention has been described in detail and with reference to specific embodiments thereof, it will be apparent to one skilled in the art that various changes and modifications can be made therein without departing from the spirit and scope thereof.

What is claimed is:

1. An image forming method comprising imagewise exposure and color development of a multilayer silver halide color photographic material comprising a support having thereon at least one silver halide light-sensitive emulsion layer comprising at least 90 mol% silver chloride and containing at least one oil-soluble coupler which is capable of forming a substantially non-diffusible cyan dye upon coupling with an oxidation product of an aromatic primary amine developing agent and which is represented by formula (I), and at least one compound selected from the group consisting of compounds represented by formula (II) or (III), wherein the compound represented by the formula (II) or (III) and the cyan coupler are present in the same oil droplets, followed by the processing of the multilayer silver halide color photographic material with at least one of a bleaching solution and bleach-fixing solution each having a pH of not greater than 6.3, wherein formula (I), (II) and (III) comprise

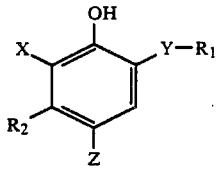

(I)

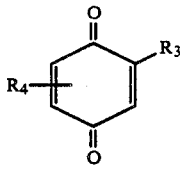

(II)

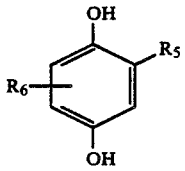

(III)

wherein Y represents —NHCO— or —CONH—; $R_1$ represents an alkyl group, an aryl group, a heterocyclic group or an amino group; X represents a hydrogen atom, a halogen atom, an alkoxy group or an acylamino group; $R_2$ represents an alkyl group or an acylamino group, or X and $R_2$ together represent a non-metallic atomic group necessary for forming a 5-membered, 6-membered or 7-membered ring; Z represents a hydrogen atom or a group capable of being released at the time of coupling with the oxidation product of the developing agent; $R_3$ and $R_5$ each represents a halogen atom, an acyl group, an alkyl- or arylsulfonyl group, or a carbamoyl group; $R_4$ and $R_6$ each represents a hydrogen atom, an alkyl group, an aryl group, an alkoxy group, an aryloxy group, an alkylthio group, an arylthio group or an amido group; and the total number of carbon atoms included in the groups represented by $R_3$ and $R_4$ or the groups represented by $R_5$ and $R_6$ is not less than 8.

2. An image forming method as claimed in claim 1, wherein the group represented by $R_1$ or $R_2$ has one or more substituents selected from an alkyl group, an aryl group, an alkyl- or aryloxy group, a carboxy group, an alkyl- or arylcarbonyl group, an alkyl- or aryloxy-carbonyl group, an acyloxy group, a sulfamoyl group, a carbamoyl group, an alkyl- or arylsulfonamido group, an acylamino group, an imido group, an alkyl- or arylsulfonyl group, a hydroxy group, a cyano group, a nitro group and a halogen atom, said substituents may be further substituted with one or more of these substituents.

3. An image forming method as claimed in claim 1, wherein X represents a halogen atom or X forms a 5-membered, 6-membered or 7-membered heterocyclic ring with $R_2$.

4. An image forming method as claimed in claim 1, wherein the group capable of being released is a halogen atom, an alkoxy group, an aryloxy group, an acyloxy group, an alkyl- or arylsulfonyloxy group, an amido group, an alkoxycarbonyloxy group, an aryloxycarbonyloxy group, an aliphatic or aromatic thio group, an imido group, an N-heterocyclic group, or an aromatic azo group.

5. An image forming method as claimed in claim 1, wherein Y represents —NHCO—.

6. An image forming method as claimed in claim 1, wherein $R_1$ represents an alkyl group or an aryl group.

7. An image forming method as claimed in claim 1, wherein Y represents —NHCO— and $R_1$ represents an alkyl group.

8. An image forming method as claimed in claim 1, wherein $R_2$ represents an alkyl group having from 1 to 15 carbon atoms.

9. An image forming method as claimed in claim 8, wherein $R_2$ is an alkyl group having from 1 to 4 carbon atoms.

10. An image forming method as claimed in claim 1, wherein Z represents a hydrogen atom or a halogen atom.

11. An image forming method as claimed in claim 1, wherein $R_4$ and $R_6$ each represents a hydrogen atom, an alkyl group, an alkylthio group or an amido group.

12. An image forming method as claimed in claim 1, wherein $R_3$ and $R_4$ or $R_5$ and $R_6$ are present at the 2- and 5-positions.

13. An image forming method as claimed in claim 1, wherein at least one of $R_3$ and $R_4$ or at least one of $R_5$ and $R_6$ is an oleophilic group.

14. An image forming method as claimed in claim 1, wherein said compound represented by formula (II) or (III) is in the form of a bis-compound, a tris-compound, an oligomer or a polymer.

15. An image forming method as claimed in claim 1, wherein said at least one compound represented by the formula (II) or (III) is present in a range from 0.1 to 100 mol% per mol of the cyan coupler.

16. An image forming method as claimed in claim 1, wherein the silver halide emulsion layer containing the cyan coupler is a red-sensitive silver halide emulsion layer.

17. An image forming method as claimed in claim 16, wherein the silver halide color photographic material further comprises at least one green-sensitive silver halide emulsion layer containing at least one magenta coupler and at least one blue-sensitive silver halide emulsion layer containing at least one yellow coupler.

18. An image forming method as claimed in claim 1, wherein the silver halide emulsion comprises silver chlorobromide or silver chloride and contains substantially no silver iodide.

19. An image forming method as claimed in claim 1, wherein the pH is from 5.3 to 6.3.

20. An image forming method as claimed in claim 1, wherein the oil droplet comprises an organic solvent having a boiling point of not lower than 160° C., a dielectric constant at 25° C. of 2 to 20 and a refractive index at 25° C. of 1.5 to 1.7.

21. An image forming method as claimed in claim 1, wherein after development bleach-fixing is conducted using bleach-fixing solution having a pH of not higher than 6.3.

22. An image forming method as claimed in claim 1, wherein $R_3$ and $R_5$ each represents an halogen atom.

* * * * *